US005638100A

United States Patent [19]

Kanematsu et al.

[11] Patent Number: 5,638,100

[45] Date of Patent: Jun. 10, 1997

[54] INK JET AND INK PRELIMINARY EJECTING METHOD

[75] Inventors: Daigoro Kanematsu; Naoji Otsuka; Kentaro Yano, all of Yokohama; Osamu Iwasaki, Kawasaki, all of Japan

[73] Assignee: Canon Kabushiki Kaisha, Tokyo, Japan

[21] Appl. No.: 508,249

[22] Filed: Jul. 27, 1995

[30] Foreign Application Priority Data

Jul. 29, 1994 [JP] Japan ..... 6-179197

[51] Int. Cl.[6] ..... B41J 2/05

[52] U.S. Cl. ..... 347/35; 347/57

[58] Field of Search ..... 347/35, 22, 57, 347/67, 26

[56] References Cited

U.S. PATENT DOCUMENTS

| | | |
|---|---|---|
| 4,313,124 | 1/1982 | Hara . |
| 4,345,262 | 8/1982 | Shirato et al. . |
| 4,459,600 | 7/1984 | Sato et al. . |
| 4,463,359 | 7/1984 | Ayata et al. . |
| 4,558,333 | 12/1985 | Sugitani et al. . |
| 4,608,577 | 8/1986 | Hori . |
| 4,723,129 | 2/1988 | Endo et al. . |
| 4,740,796 | 4/1988 | Endo et al. . |
| 5,166,699 | 11/1992 | Yano et al. . |
| 5,367,325 | 11/1994 | Yano et al. . |
| 5,440,330 | 8/1995 | Anderson ..... 347/26 |

FOREIGN PATENT DOCUMENTS

| | | | |
|---|---|---|---|
| 59-123670 | 7/1984 | Japan | B41J 3/04 |
| 59-138461 | 8/1984 | Japan | B41J 3/04 |

*Primary Examiner*—Joseph W. Hartary

*Attorney, Agent, or Firm*—Fitzpatrick, Cella, Harper & Scinto

[57] ABSTRACT

An ink jet apparatus includes an ink jet head having a plurality of ejecting ports arranged in a predetermined pattern and a plurality of heat generating elements arranged corresponding to the ejecting ports, and a driving controlling means for applying a driving signal to heat generating elements 1*e* in response to a driving information wherein a printing mode of printing a printing medium by ejecting ink from the ejecting ports and a preliminary ejecting mode of performing no ejection toward the printing medium are settled for the apparatus. The driving controlling means includes a defoaming position changing means for changing the position of a defoaming point $P_B$ arising on each heat generating element 1*e* when ink is ejected in conformity with the preliminary ejecting mode. With this construction, a density fluctuation in character, image or the like can be eliminated, and moreover, a quantity of consumption of ink usable for preliminary ejection can be reduced compared with a conventional ink jet apparatus. In addition, an ink preliminary ejecting method to be practiced by the ink jet apparatus is also provided.

9 Claims, 14 Drawing Sheets

INK JET AND INK PRELIMINARY EJECTING METHOD

BACKGROUND OF THE INVENTION

1. Field of the Invention

The present invention relates to an ink jet apparatus for conducting printing ejection for a printing medium by ejecting ink from ejection ports as well as conducting preliminary ejection without any printing on the printing medium.

2. Description of the Related Art

Various kind of recording apparatus such as printer, copying machine, facsimile and so forth is constructed such that character and image each composed of dot pattern are printed on a printing medium such as a sheet of paper, a sheet of plastic thin plate or the like in response to character information or image information.

The recording apparatus can be classified into an ink jet system, a wire dot system, a thermal system, a laser beam system in terms of a recording system.

Among them, the ink jet system is such that each printing operation is performed by ejecting ink from an ink jet head to a printing medium, and has advantages that an image having excellent finesse can be printed at high speed, since the ink jet system is no impact system, few nosy sound is generated during printing operation, and moreover, colored image can easily be printed on the printing medium using multicolored inks. Especially, a system wherein a heat generating element is used as an ejection energy generating element for generating energy for ejecting ink therefrom has advantages that a head can be designed with small dimensions and recording can be achieved with high fineness.

With respect to an ink jet system having a heat generating element used therefor, there sometimes arises an occasion that part of dyestuff, pigment or the like is thermally decomposed on the heat generating element depending on the kind of ink, the state of usage of the head or the like, causing the decomposed substance to be adhesively deposited on the heat generating element. Due to the fact that an intensity of ink ejecting force is lowered because of the presence of adhering ingredient (hereinafter referred to as ink adhering ingredient), causing no normal ejection to be conducted, and moreover, a quantity of ink adhering ingredient differs among a plurality of heat generating elements, causing ink ejecting force to differ for each of heat generating elements, there is a danger that density fluctuation arises with formed character or image. Namely, with a conventional ink jet apparatus, there arises an occasion that the kind of available ink is restricted in order to accomplish a high quality of printing, and moreover, density fluctuation arises with character or image to be formed due to a difference of usage of the heat generating element.

Conventionally, the following measures have been proposed as a method of removing the adhesively deposited material on a heat generating element by the cavitation arising at the time when a foam caused by the heat generated by the heat generating element disappears, with respect to printing density fluctuation caused by the adhesive deposition. (1) Foams are repeatedly formed while part or the whole of ejection ports of an ink jet head is kept closed. (2) Preliminary ejection is performed using all the heat generating elements with a constant width of driving signal and a constant driving cycle. (3) Means for counting the number of usage of every heat generating element is disposed and the number of times of preliminary ejection is changed with respect to each of heat generating elements. (4) Pulse width modulation control (PWM control) is performed in conformity with a printing ejection mode of printing a printing medium by ejecting ink from ejection ports.

Among the conventional measures for removing density fluctuation of character, image or the like by adhesively depositing of ink adhering element on the heat generating element, with the measure shown in the paragraph (1), the defoaming position can be changed depending on a manner of closing the ejecting ports, but since it is very difficult to control the manner of closing the ejecting ports, it is also difficult that ink adhering ingredient present in the wide range on the heat generating element is sufficiently removed. In addition, after processing is performed, ink adheres to the ejection port plane of the ink jet head. Thus, it is necessary to perform recovering treatment for removing the adhering ink. Since foam is generated while the ejecting ports are kept closed, bubble remaining after defoaming stays in ink jet head. Therefore, there is a danger that the staying bubble becomes a factor of incorrect printing (ejection of foam, warpage of ink ejection) unless recovering treatment is performed.

With the measure explained in the paragraph (2), since preliminary ejection is performed with a constant width of driving signal and a constant driving cycle, ink adhering ingredient present in the wide range on the heating element can not sufficiently be removed. Indeed, it is difficult to eliminate a difference in a quantity of ink adhering ingredient with respect to each of heat generating elements. For this reason, density fluctuation of character, image or the like can not sufficiently be eliminated. A problem to be solved is that a quantity of ink to be used for preliminary ejection becomes very large.

With the measure shown in the paragraph (3), a difference in a quantity of ink adhering ingredient between respective heat generating elements can be eliminated. However, another problem to be solved is that a quantity of consumption of ink to be used for preliminary ejection is still large.

The PMW controlling method shown in the paragraph (4) is practiced to modulate the pulse width corresponding to the temperature of the ink jet head, and moreover, to maintain a quantity of ink ejection at the time of printing ejection constant. As one example, the driving signal is divided into two (prepulse and main pulse) and the pause time of prepulse and main pulse is modulated. However, the PWM controlling method is a controlling method for maintaining a quantity of ink ejection constant by shortening the pause time when the ink jet head has a higher temperature and elongating the pause time when the ink jet head has a lower temperature. Therefore, since the defoaming position on the heat generating element is dependent on a quantity of ink ejection, the defoaming position does not large vary. Namely, with the PWM controlling method at the time of printing ejection, the ink adhering ingredient dispersively deposited on the heat generating element can not sufficiently be removed.

OBJECT OF THE INVENTION

An object of the present invention is to provide an ink jet apparatus which assures that density fluctuation in character, image or the like can be eliminated ad which makes it possible to reduce a quantity of ink to be used for preliminary ejection compared with a conventional ink jet apparatus.

In addition, other object of the present invention is to provide an ink preliminary ejecting method to be practices by the ink jet apparatus which assures that density fluctuation in character, image or the like can be eliminated and which makes it possible to reduce a quantity of consumption of ink to be used for preliminary ejection compared with the conventional ink jet apparatus.

SUMMARY OF THE INVENTION

According to a first aspect of the present invention, there is provided an ink jet apparatus including an ink jet head having a plurality of ejecting ports arranged in a predetermined pattern and a plurality of heat generating elements arrange corresponding to the ejecting ports, and driving controlling means for applying a driving signal to the heat generating elements in response to a driving information so as to allow the heat generating element to generate heat to generate bubbles from ink and to defoam wherein a printing ejecting mode for printing a printing medium by ejecting ink from the ejecting ports and a preliminary ejecting mode for performing no ejection toward the printing medium are settled for the apparatus, characterized in that the driving controlling means includes defoaming position changing means for changing the position of a defoaming point while the apparatus is operated in conformity with the preliminary ejecting mode.

The driving signal is composed of a prepulse, a main pulse, and a pause time between the prepulse and the main pulse, and it is preferable that the defoaming position changing means performs ejection by modulating at least one of the prepulse and the pause time by two steps or more so as to change the position of a deforming point.

According to a second aspect of the present invention, there is provided an ink jet apparatus including an ink jet head having a plurality of ejecting ports arranged in a predetermined pattern and a plurality of heat generating elements arranged corresponding to the ejecting ports, and driving controlling means applying a driving signal to the heat generating elements in response to a driving information so as to allow the heating elements to generate heat to generate bubble from ink and to defoam wherein a print ejecting mode for printing a printing medium by ejecting ink from the ejecting ports and a preliminary ejecting mode for performing no ejection toward the printing medium are settled for the apparatus, characterized in that the driving controlling means includes ink adhering ingredient depositing means for allowing a predetermined quantity of ink adhering ingredient to be preliminarily deposited on the heat generating elements in conformity with the preliminary ejecting mode and ink adhering ingredient peeling means for peeling the ink adhering ingredient on the heat generating elements deposited by the ink adhering ingredient depositing means, It is preferable that the ink adhering ingredient depositing means changes and drives at least one of a width of driving signal, a driving voltage and a driving cycle in such a manner that a maximum reached temperature of the surface of each heat generating element coming in contact with ink is relatively heightened. In this case, it is effective that a sum $P_{W1}$ of a width of prepulse and a width of main pulse of the driving signal applied to the heat generating elements by the ink adhering ingredient depositing means and a sum $P_{W2}$ of a width of prepulse and a width of main pulse of the driving signal applied to the heat generating elements by the adhering ingredient peeling means satisfy the relationship represented by the following inequality.

$$1.1\times P_{W1} \leqq P_{W2} \leqq 2.5\times P_{W1}$$

and, it is effective that a cycle $F_{q1}$ that the ink adhering depositing means applies a driving signal to a same heating element and a cycle $F_{q2}$ that the ink adhering ingredient peeling means applies a driving signal to a same heat generating element satisfy the relationship represented by the following inequality $$F_{q1} < F_{q2}$$

In addition, according to the third aspect of the present invention, there is provided an ink jet apparatus including an ink jet head having a plurality of ejecting ports arranged in a predetermined pattern and a plurality of heat generating element arranged corresponding to the ejecting ports, and driving controlling means applying a driving signal to said heat generating elements in response to a driving information so as to allow the heat generating elements to generate heat to generate bubble from ink and to defoam wherein a printing ejecting mode for printing medium by ejecting ink from the ejecting ports and a preliminary ejecting mode for performing no ejection toward the printing medium are settled for the apparatus, characterized in that the driving controlling means includes ink adhering depositing means for allowing a predetermined quantity of ink adhering ingredient to be preliminarily deposited on the heat generating elements in conformity with the preliminary ejecting mode, ink adhering ingredient peeling means for peeling the ink adhering ingredient on each heat generating element deposited by the ink adhering ingredient depositing means, and a heat generating element usage state capturing means for capturing the usage state of each heat generating element or dividing the heat generating elements into two groups to capture the usage state of each of divided heat generating elements, and that the driving signal is controlled in conformity with the preliminary ejecting mode based on the usage state captured by the heat generating element usage capturing means.

It is preferable that the heating element usage state capturing means includes printing dot counting means, counting means for counting a printing time, and means for seeking a printing duty, and that the usage state of the heating element is captured by the means for seeking a printing duty.

Further, according to the fourth aspect of the present invention, there is provided an ink preliminary ejecting method to be practiced by an ink jet apparatus including an ink jet head having a plurality of ejecting ports arranged in a predetermined pattern and a plurality of heat generating elements arranged corresponding to the ejecting ports, and driving controlling means applying a driving signal to the heat generating elements in response to a driving information so as to allow the heat driving elements to generate heat to generate bubbles from ink and to defoam wherein a printing ejecting mode for printing a printing medium by ejecting ink from the ejecting ports and a preliminary ejecting mode for performing no ejection toward the printing medium are settled for the apparatus, characterized in that the preliminary ejecting mode includes a first preliminary ejecting step of allowing a predetermined quantity of ink adhering ingredient to be deposited on each heating element and a second preliminary adhering step of peeling from the heat generating elements an ink adhering ingredient adhesively deposited by practicing the first preliminary ejecting step.

According to the first aspect of the present invention, it is possible to change the position of cavitation induced on the heat generating element at the time of defoaming. In other words, the ink adhering ingredient dispersively deposited can be peeled from the whole surface of the heat generating elements.

According to second aspect and the fourth aspect, by peeling the ink adhering ingredient from the heat generating element by the ink adhering ingredient peeling means after the ink adhering ingredient is preliminarily adhesively deposited on the whole surface of the heat generating element with the aid of the ink adhering ingredient depositing means, the ink adhering ingredient can be peeled at a higher efficiency than the case that the ink adhering ingredient partially adhesively deposited on the heat generating element can be peeled.

According to the third aspect, a quantity of ink adhering ingredient deposited on the heat generating elements can be presumed by capturing the usage state of the heat generating elements, and since optimum preliminary ejection can be executed for each heat generating element, ink adhering ingredient can be removed with a minimum quantity of ink consumption without any deterioration of running life of the heat generating elements.

The above and other objects, effects, features and advantages of the present invention will become more apparent from the following description of embodiments thereof taken in conjunction with the accompanying drawings.

DESCRIPTION OF THE PREFERRED EMBODIMENT

The present invention will now be described in detail hereinafter with reference to FIG. 1 to FIG. 14 with respect to an embodiment wherein an ink jet apparatus of the present invention is applied to an ink jet printer.

Figure 1:
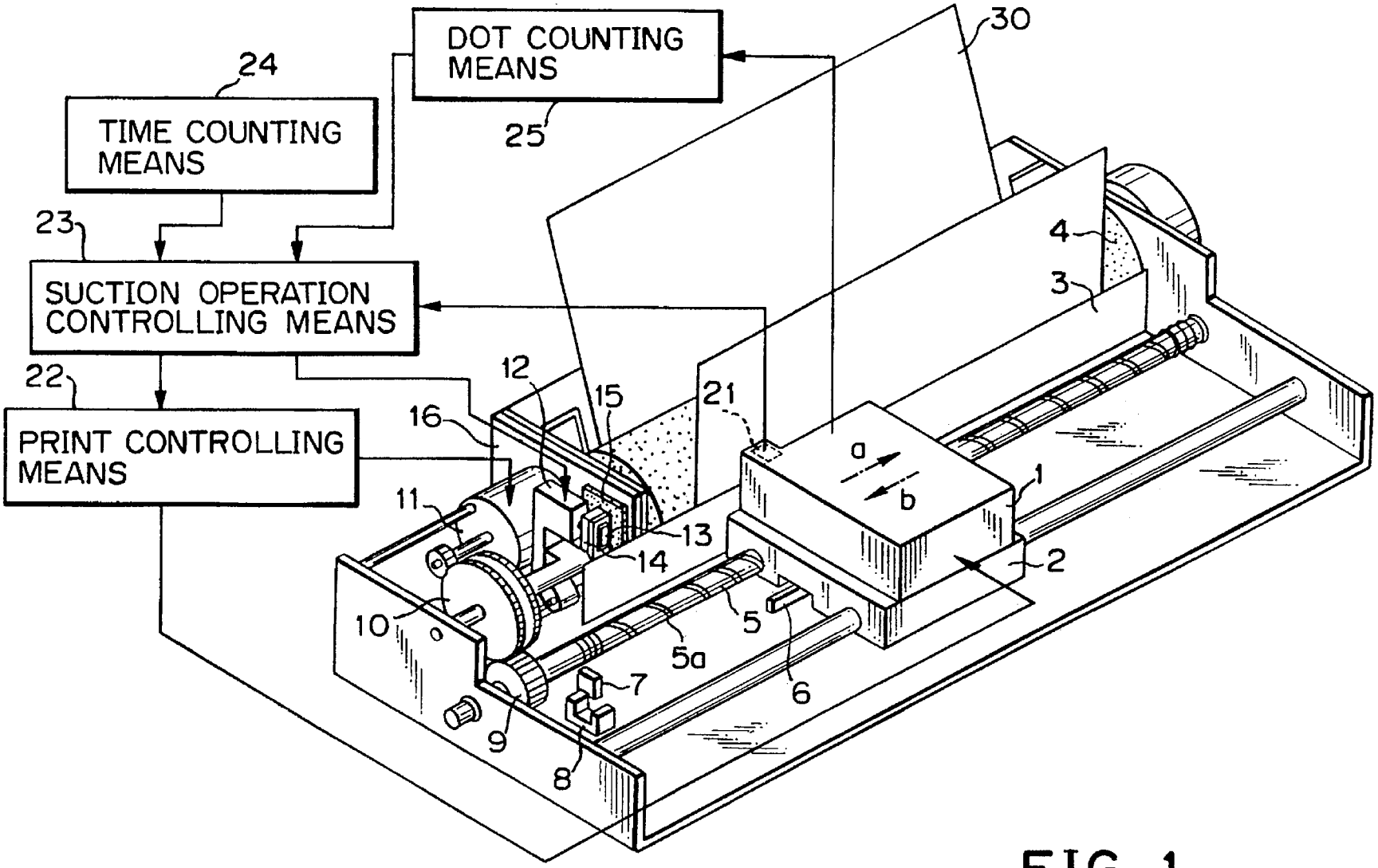
FIG. 1 is a perspective view which schematically shows the structure of an embodiment wherein an ink jet apparatus of the present invention is applied to a printer.

As shown in FIG. 1 which represents an appearance of the ink jet printer of this embodiment, as normal and reverse rotation of a driving motor 11 is transmitted to a feed screw 5 via two driving power transmitting gears 9 and 10, a carriage 2 is reciprocably displaced in a arrow-marked direction or in the b arrow-marked direction, An ink jet cartridge 1 integrated with an ink jet head 18 (see FIG. 2) for ejecting ink toward a printing medium 30 such as a sheet of paper or the like and an ink tank having a printing ink received therein is mounted on a carriage 2. In addition, a platen 4 for conveying the printing medium 30 is rotatably arranged while facing to the ink jet cartridge 1.

The printing medium 30 conveyed by the platen 4 is thrusted against the platen by a paper retainer 3, and moreover, it is held in such a manner as to maintain a predetermined gap between the printing medium 30 and the ink jet cartridge 1. A printing operation for ejecting ink from the ink jet head 18 while displacing the carriage 2 with the aid of the driving motor 11 is performed under control of a print controlling means 22. At this time, the number of printed dots is counted by counting means 25. A temperature sensor 21 for measuring the temperature of the ink jet head 18 is attached to the ink jet head 8 for the ink jet cartridge so that a quantity of electricity corresponding to the measured temperature is outputted to suction operation controlling means 23.

It should be noted that the temperature sensor 21 is not always required and the temperature sensor 21 is attached to the ink jet head 1 but any type temperature sensor can be attached to the ink jet apparatus at an arbitrary position, provided that it is proven that the temperature of the ink jet head 18 can be presumed.

Two photocouplers 7 and 8 are disposed on the left-hand side as viewed in the displacing direction of the carriage 2. The photocouplers 7 and 8 serve as home position detecting means for confirming that a lever disposed at the left-hand end of the carriage 2 is present in the range including the photocouplers 7 and 8 and then shifting the direction of rotation of the driving motor 11. In addition, a capping member 13 supported by a cap supporting member 14 is disposed at the position where the ink jet cartridge 1 is displaced at the time of sucking operation outside the range that the ink jet cartridge 1 is reciprocably displaced during printing operation. The capping member 13 is intended to cap the whole ejecting outlet plane 1*a* (see FIG. 2) of the ink jet head 18 therewith, and while the injecting head 18 is completely capped with the capping member 13, ink having increased viscosity and bubbles remaining in the ink jet head 18 are removed from the injecting head 18 so as to conduct receiving operation.

A cleaning blade 25 supported by a blade supporting member 16 is disposed sideward of the capping member 13. The cleaning blade 15 is supported so as to enable to project toward the ink cartridge 1 until it comes in contact with the ink jet head 18. Thus, after completion of a sucking operation, the cleaning blade is projected toward the moving path of the ink jet cartridge 1 to wipe off dirty material on the front surface of the ink jet head 18 as the ink jet cartridge is displaced. The cleaning blade 25 should not be limited only this type, and it is acceptable that other hitherto known cleaning blade is employed for the same purpose.

Figure 2:
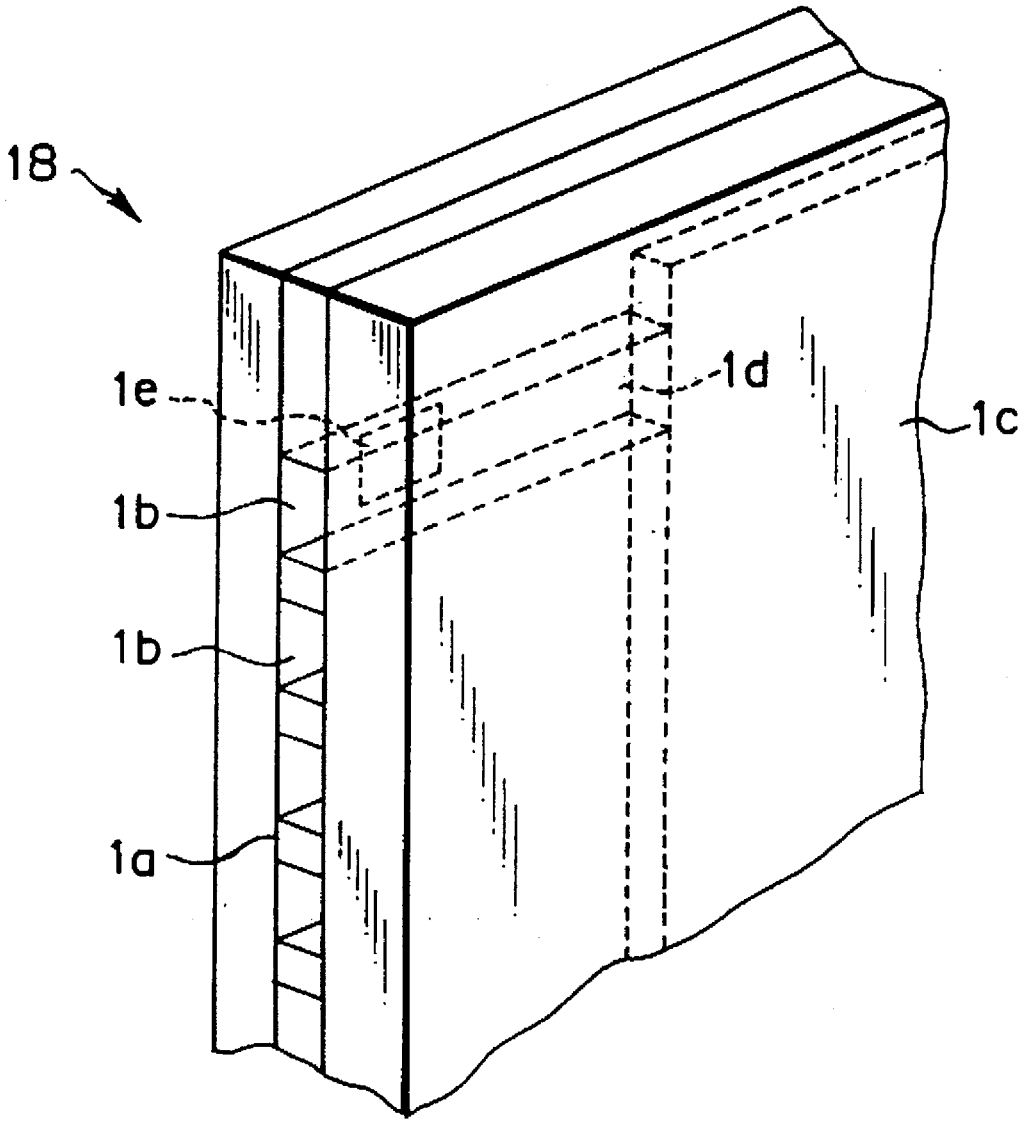
FIG. 2 is a fragmentary enlarged perspective view which shows an ink jet head shown in FIG. 1.

As shown in FIG. 2 that is a fragmentary enlarged view of the ink jet head 18, a plurality of ejecting ports 1*b* are formed on the ejecting port plane 1*a* facing to the printing medium 30 (see FIG. 1) with a predetermined gap therebetween and with a predetermined pitch, and a plurality of heat generating elements 1*e*(electrothermal transducers used in this embodiment) each serving to generate thermal energy for ink ejection are arranged along wall surfaces of ink paths 1*d* by way of which a common ink chamber 1*c* is communicated with each ejecting port 1*b*. The common ink chamber 1*c* is communicated with the ink tank of the ink jet cartridge 1 (see FIG. 1) so that ink is supplied to the ink tank from the common ink chamber 1*c*. The ink supplied from the ink tank to the common ink chamber 1*c* and temporarily stored in the common ink chamber 1*c* maintains the state that an ink path 1*d* is filled with ink under the influence of a capillary phenomenon. When electricity is fed to the heat generating element 1*e* and heat is generated with the printing element 1*e* via an electrode (not shown), ink exposed to the heat generating element 1*e* is quickly heated to generate bubbles in the ink tank 1*d* attributable to an appearance of a phenomenon of film boiling, and as the bubbles are generated, ink is ejected from the ejecting ports 1*d*.

Figure 3:
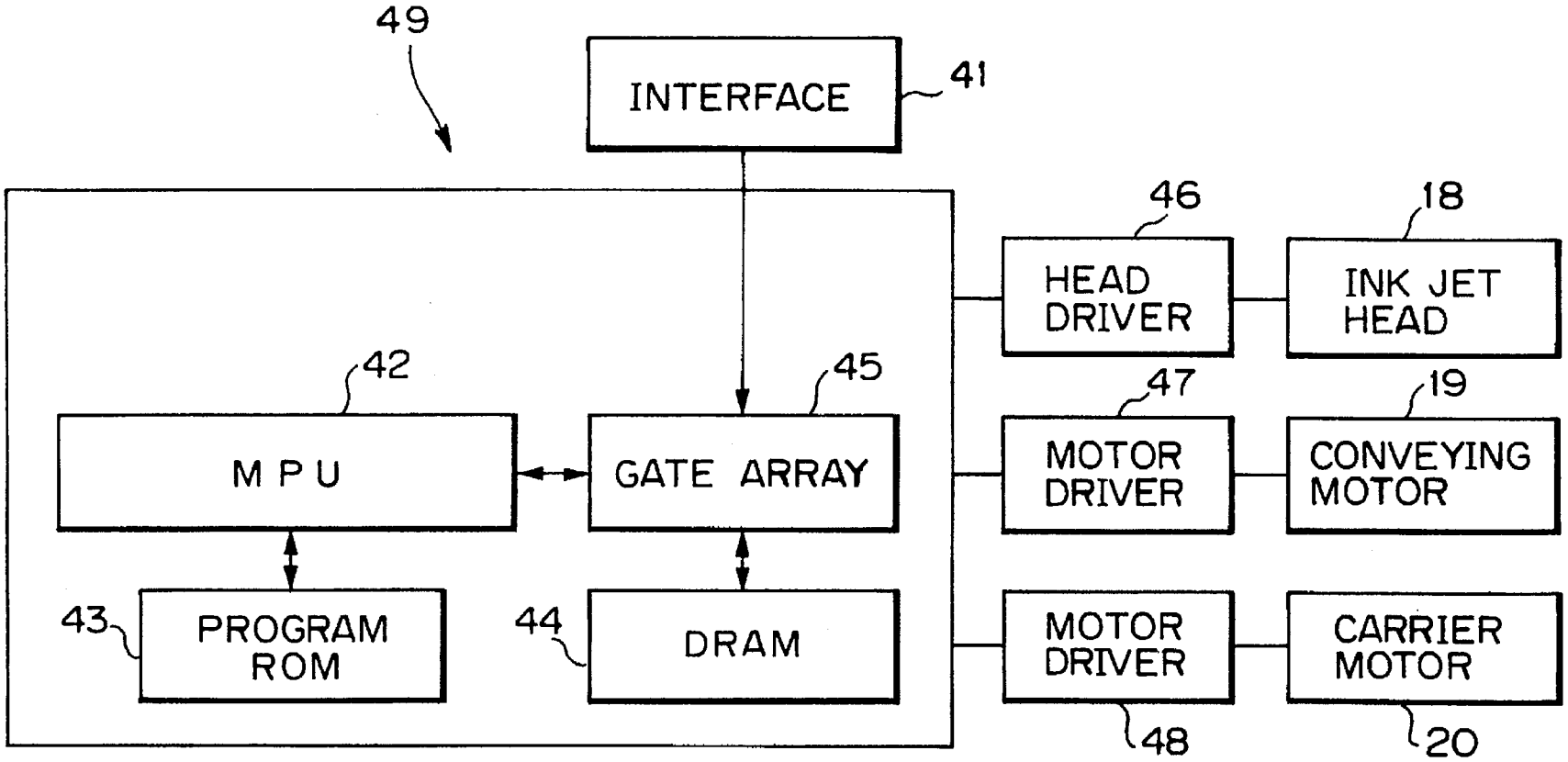
FIG. 3 is a control block diagram in the embodiment shown in FIG. 1 and FIG. 2.

FIG. 3 shows the block structure including controlling means 49 in this embodiment. In detail, reference numeral 41 denotes an interface into which a printing signal is inputted, and reference numeral 42 denotes a microprocessor (hereinafter referred to as MPU). Reference numeral 43 denotes a program ROM in which a control program to be executed by MPU 42 is stored, reference numeral 44 denotes a DRAM in which various data such as a printing signal, printing data to be fed to the ink jet head 18 and so forth is reserved. The number of printed dots, the number of replacements of the ink jet head 18 and so forth can be stored in DRAM 44. Reference numeral 45 denotes a gate array for controllably supply printing data to the ink jet head 18 so as to allow data to be controllably transferred among the interface 41, the MPU 42 and the DRAM 44. Reference numeral 20 denotes a carrier motor for conveying the ink jet head 18, and reference numeral 19 denotes a conveyance motor for conveying a printing paper. Reference numeral 46 denotes a head driver for driving the ink jet head 18, and reference numerals 47 and 48 denote motor driver for driving the conveyance motor 19 and carrier motor 20.

Figure 4:
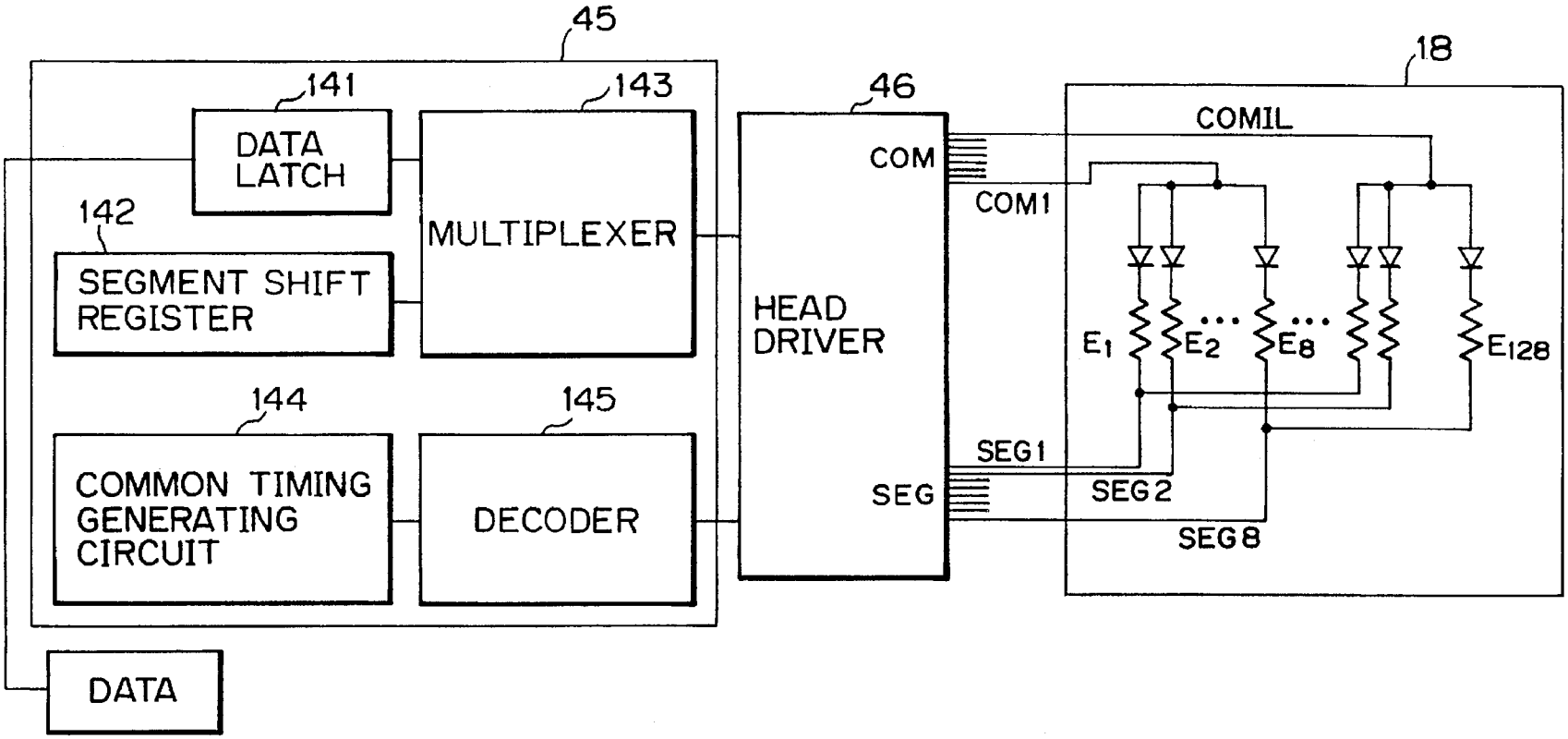
FIG. 4 is a circuit diagram which shows a part of the control block shown in FIG. 3.

FIG. 4 shows a part of circuits of the controlling means shown in FIG. 30. Specifically, the gate array 45 includes a data latch 141, a segment shift register 142, a multiplexer 143, a common timing generating circuit 144 and a decoder 145. The ink jet head 18 is constructed in the form of a diode matrix, and when a common signal COM and a segment signal SEG match with each other, a driving current flows to heat generating elements 1*e* (in this embodiment, $E_1$ to $E_{128}$) so that ink is heated and ejected to each ejecting port 1*b*.

The decoder 145 decodes a timing generated by a common timing generating circuit 144 and selects one of common signals COM1 to COM16. The data latch 141 latches the printing data read from DRAM with eight bit in unit, and the multiplexer 143 follows a segment shift register 142 in conformity with the print data to output the print data as segment signals SEG1 to 8. The output from the multiplexer 143 can variously be changed depending on the content of the segment shift register 142 with one bit in unit, with two bits in unit or with eight bits in unit.

Operations of the controlling means will be described below. Namely, when a printing signal is inputted into the interface 41, the printing signal is converted into printing data between the gate array 45 and the MPU 42. Then, motor drivers 47 and 48 are driven, and the ink jet head 18 is driven in conformity with the printing data sent from the head driver 46 so that a printing operation is performed.

Here, description will be made below with respect to an example wherein ink adhering ingredient adhesively deposited on a heat generating element 1*e* is removed by modulating a driving signal of preliminary ejection by multi-steps (hereinafter referred to as a first concrete example).

During a normal printing operation, a predetermined ink adhering ingredient is deposited on the heat generating element 1*e* corresponding to the state of usage (the kind of ink, the number of heating, a driving frequency, a driving pulse and so forth). Generally, there is a tendency that a quantity of ink adhering ingredient adhesively deposited on the heat generating element is increased more and more as a driving frequency is higher and a driving pulse is larger. The reason for this consists in that the maximum temperature which can be reached by the heat generating element 1*e* is high. As ink adhering ingredient is increasingly deposited on the heat generating element 1*e*, uniform film bolding does not arise with the heat generating element Ie. As a result, an intensity of ink ejecting force is reduced and a quantity of ink ejection is reduced. With respect to the ink adhering ingredient adhesively deposited on the heat generating element 1*e*, the ink adhering components located in the vicinity of a defoaming point peels due to such cavitation that the surrounding ink collides against the heat generating element 1*e* during defoaming. Therefore, during normal printing, deposition and peeling of the ink adhering ingredient are repeated on the heat generating element 1*e*, and a quantity of ink ejection always varies.

In the case of an ink jet printing apparatus including a plurality of heat generating elements 1*e* and having such a structure that a certain specific heat generating element group A and another specific heat generating element group B are separately used, periodical deviation arises between a quantity of deposition of the ink adhering ingredient of the heat generating element group A and that of the heat generating element group B, and in the case that an image is formed by simultaneously ejecting the heat generating element group A and the heat generating element group B, density fluctuation appears.

According to the preset invention, to obviate the density fluctuation, a measure is taken such that the defoaming point on the heat generating element 1*e* deviated by modulating the driving signal at the time of preliminary ejection, and moreover, the ink adhering element within the wide range of the surface of the heat generating element 1*e* is peeled.

Figure 5:
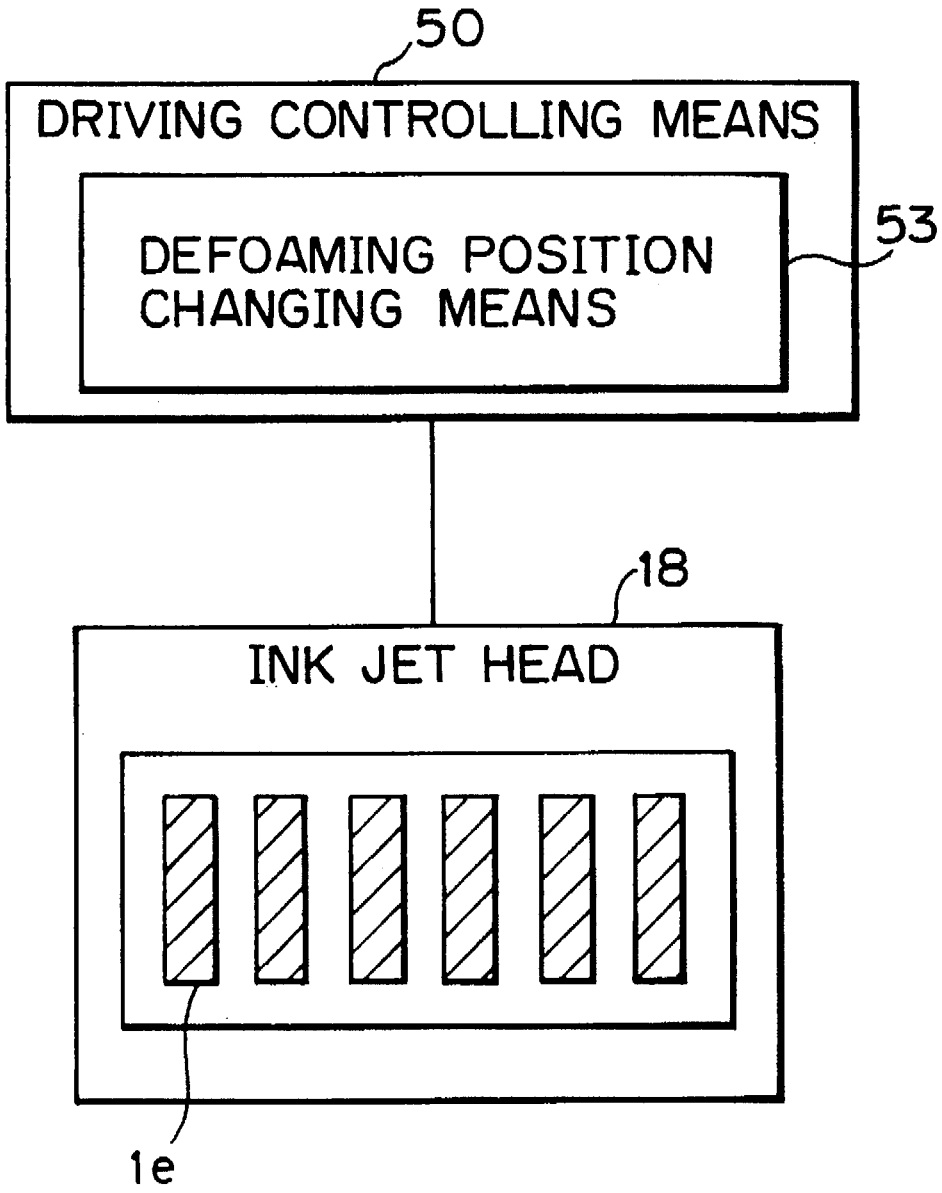
FIG. 5 is a control block diagram of a first concrete example in this embodiment.

FIG. 5 shows schematic structure of a block of the present invention, Here, the driving controlling means 50 includes a deforming position changing means 53 for changing the defoaming position of the heat generating element 1*e* in the ink jet head 18, and performs driving controlling for the heat generating element 1*e* with a predetermined driving signal, and at a redetermined cycle and a predetermined number of times in conformity with a preliminary ejecting mode.

Table 1 shows preliminary ejecting conditions employed for this embodiment.

TABLE 1

| | driving frequency (Hz) | prepulse width (μs) | pause time (μs) | main pulse width (μs) | number of pulses |
|---|---|---|---|---|---|
| preliminary ejection A | 500 | 1.0 | 0.0 | 4.2 | 100 |
| preliminary ejection B | 500 | 1.0 | 0.0 | 4.3 | 100 |
| preliminary ejection C | 500 | 1.0 | 1.8 | 4.2 | 100 |
| preliminary ejection D | 500 | 1.0 | 2.7 | 4.2 | 100 |

Figure 6:
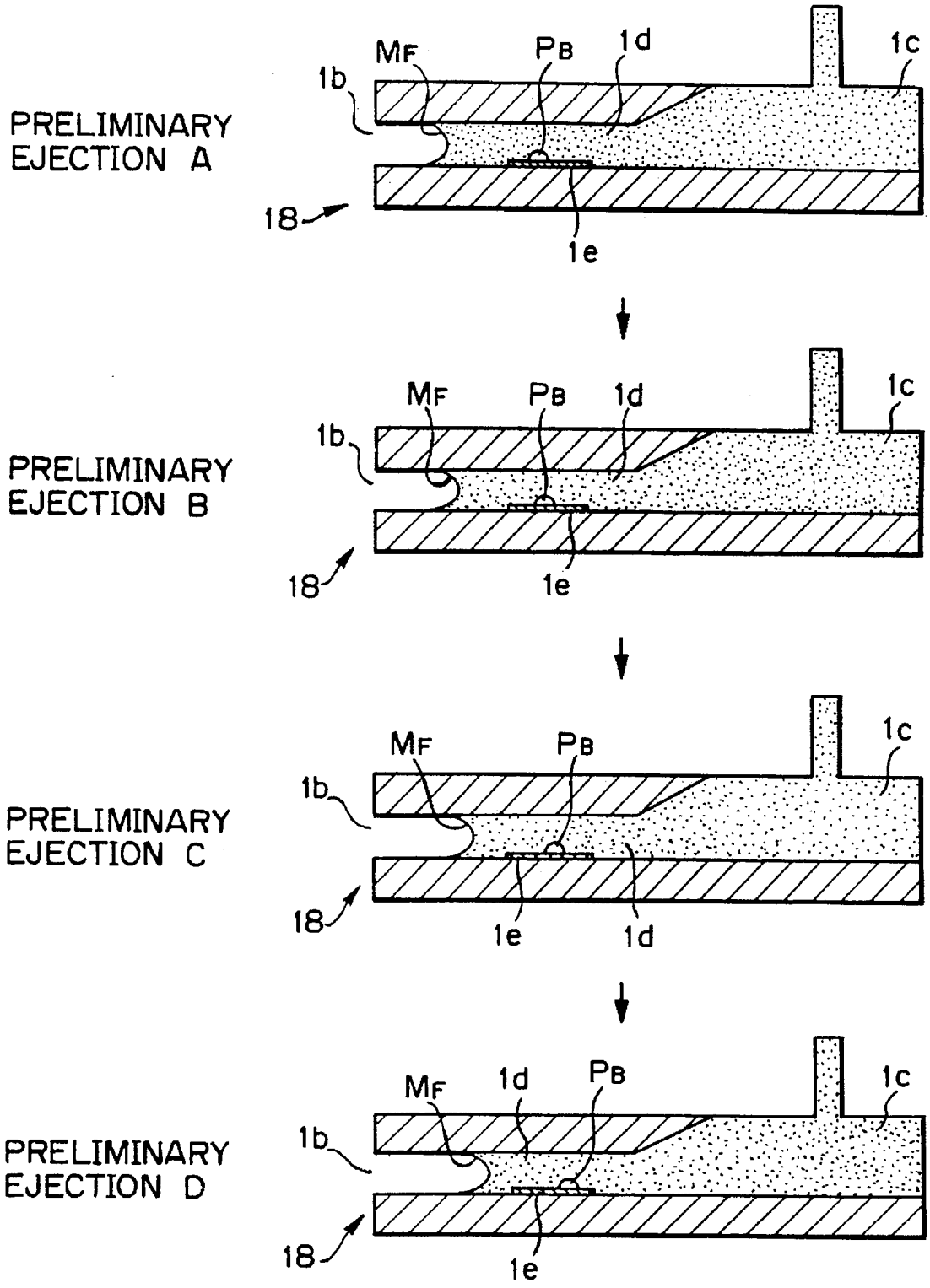
FIG. 6 is a sectional view of the fore end part of an ink jet head which represents the relationship between a preliminary ejection and a defoaming point in the first concrete example.

FIG. 6 shows positional deviation of the defoaming point when preliminary ejection A to preliminary ejection D are successively conducted. As is apparent from FIG. 6, as the width of the pause time is increased, the defoaming point $P_B$ shifts from the ejecting port 1*b* to the position away from the former. This means that as a width of the pause time is enlarged, a quantity of ejection of ink increased and a quantity of ink remaining from the central position of the heat generating element 1*e* to the ejection port 1*b* side is reduced, resulting in the ink being pulled in the opposite direction to the ejecting port 1*b*.

When preliminary ejection is performed while the preliminary ejection A to the preliminary ejection D are taken as a series of preliminary ejecting operations, the position where cavitation occurs on the heat generating element 1*e* is displaced, whereby it becomes possible to peel the ink adhering ingredient within the wide range on the heat generating element 1*e*. Thus, it is possible to obviate density fluctuation by keeping a quantity of ejection between the heat generating element 1*e* constant but depending on the frequency of usage of the heat generating element 1*e*.

The preliminary ejection for peeling the ink adhering ingredient makes it possible to reduce a quantity of consumption of ink by warpage of ink ejection during printing operation due to fixing of the ink adhering ingredient to the ink passage 1*d* and vaporization of water from the surface $M_F$ of the meniscus or by ejecting ink at a timing for preliminary ejection for the purpose of preliminarily preventing the failure of ink ejection. Concretely, preliminary ejection can be performed when a predetermined number of dots can be counted with the aid of disposed dot counting means or it can be performed with the aid of counting means for counting the printing operation when a predetermined time elapses. In addition, it is acceptable that a preliminary ejecting distance is changed or a predetermined cycle of time is changed by using means for presuming or detecting the temperature of the ink jet head. It is preferable that the ink jet head is ready to stably perform printing operation using the ink jet head.

Figure 7:
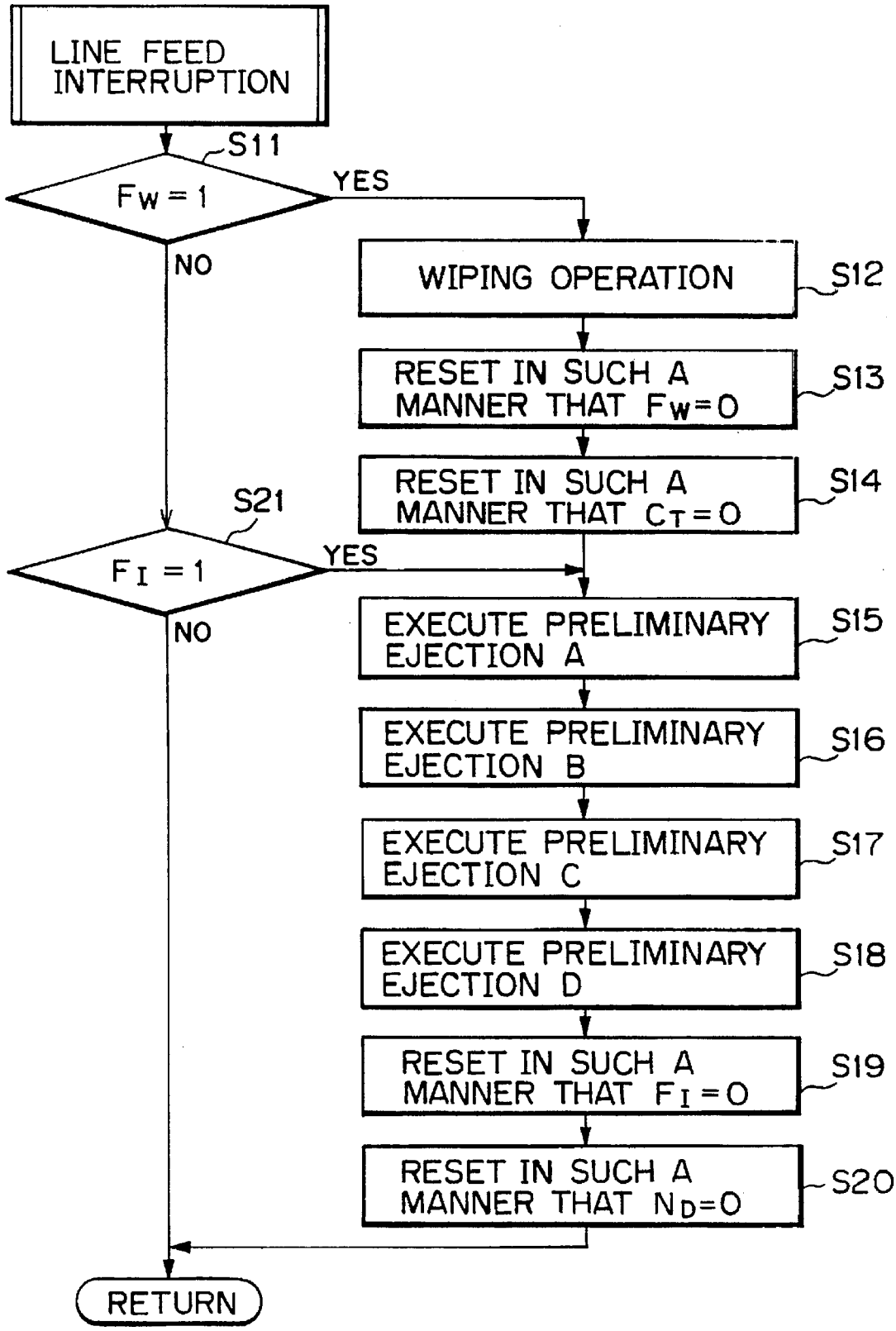
FIG. 7 is a flowchart which represents a series of steps for line feed interruption in the first concrete example.
Figure 8:
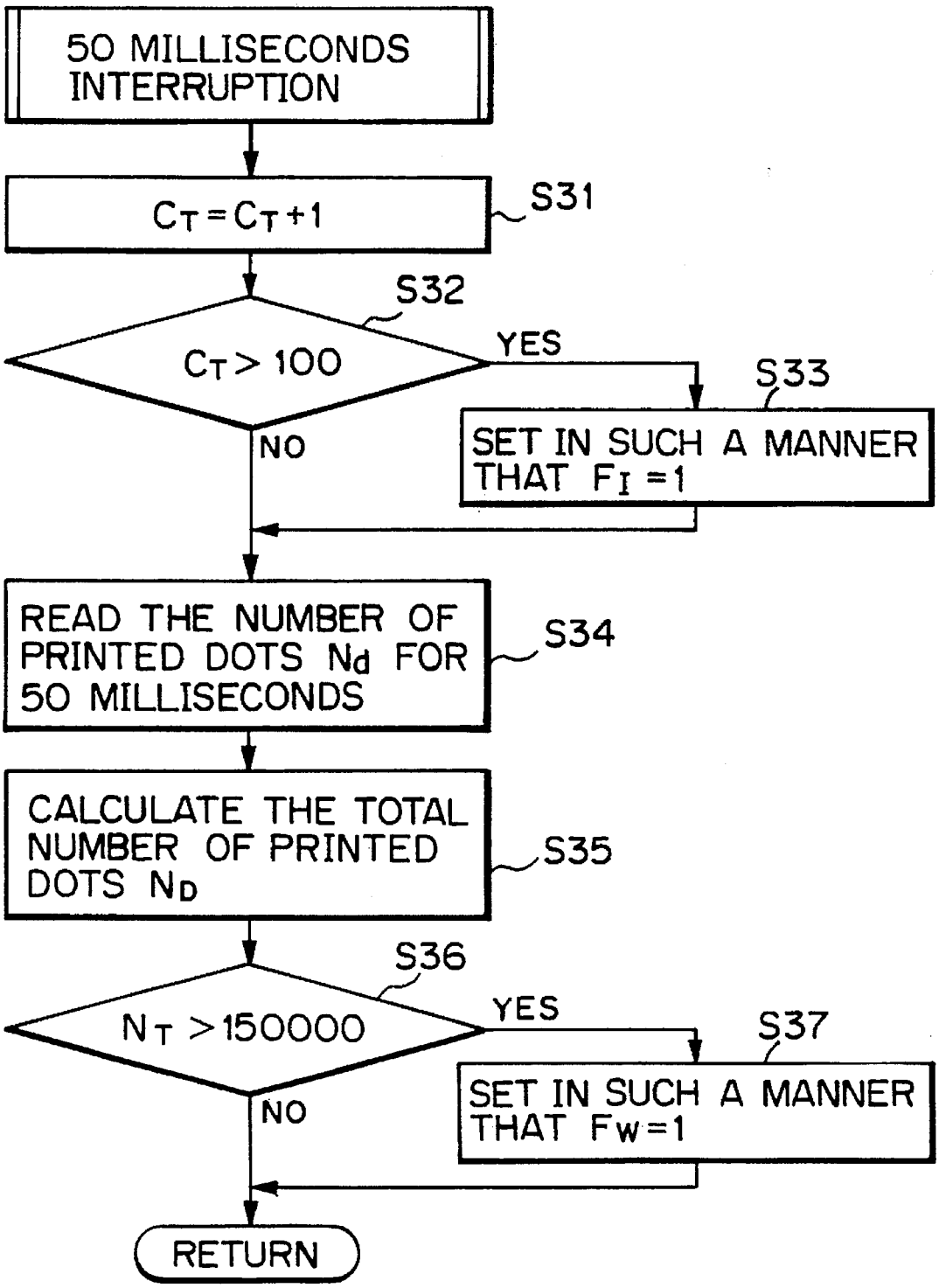
FIG. 8 is a flowchart which represents a series of steps for a 50 millisecond interruption processings in the first concrete example.

FIG. 7 and FIG. 8 show a series of steps to be practiced for preliminary ejection in accordance with this embodiment. FIG. 7 shows a line interruption subroutine to be executed every time line is changed, and FIG. 8 shows a 50 millisecond interruption subroutine to be executed every 50 milliseconds. In this embodiment, the aforementioned preliminary ejections A to D are practiced every five seconds at the time of printing operation and at the time of standby that the capping member 13 is parted away from the ejecting port plane 1*a*, and moreover, they are practiced after completion of wiping operation in the case that the number of printed dots exceeds a predetermined one.

In a step of line feed interruption shown in FIG. 7, it is determined whether or not preliminary ejection flag $F_1$ and wiping flag $F_w$ are set to 1. In the case that it is found that the wiping flag is set to 1, wiping operation is performed, and subsequently, preliminary ejections A to D are performed. After completion of each processing, flag is reset to 0 and timer counting value $C_r$ is reset to 0. Namely, it is determined in Step S11 whether or not wiping flag $F_W$ is set to 1 and in the case that it is determined that it is set to 1, the subroutine goes to Step S12 in which wiping operation is performed. Subsequently, in Step S13, wiping flag $F_w$ is reset to 0, and moreover, in Step S14, timer counting value $C_r$ is reset to 0. The subroutine goes to Step S15 to Step S18 in which preliminary ejections A to D are successively performed, and thereafter, at Step S19, preliminary ejecting flag $F_1$ is reset to 0, and moreover, in Step S20, total printed dot number $N_p$ is reset to 0, whereby interruption processing is completed.

On the other hand, in the case that it is determined in Step S11 that wiping flag $F_w$ is not set to 1, the subroutine goes to Step 21 in which it is determined whether preliminary ejecting flag $F_1$ is set to 1 or not. In the case that it is found that preliminary flag $F_1$ is set to 1, the subroutine goes to Step S15 and subsequent ones. However, in the case that it is determined that preliminary ejecting flag $F_1$ is reset to 0, interruption processing is completed while nothing is done.

On the other hand, in the 50 millisecond interruption shown in FIG. 8, timer counts for five seconds and the number of printed dots is counted. In the case that the result derived from each counting exceeds a specified value, preliminary ejecting flag $F_1$ and wiping flag $F_w$ are set to 1, respectively. Namely, in Step 31, timer count value $C_T$ is increased by one and the subroutine goes to Step 32 in which it is determined whether the count value $C_r$ exceeds 100 or not. In the case that it is determined that the timer count value $C_r$ exceeds 100, the subroutine goes to Step S33 in which preliminary flag $F_1$ is set to 1, and thereafter, the subroutine goes to Step S33 in which preliminary ejecting flag F1 is set to 1, and thereafter, in Step S34, the number of printed dot number $N_d$ for 50 milliseconds till now is read and the subroutine goes to Step S35 in which the total printed dot number $N_D$ till this time is calculated in accordance with the following equation.

$$N_D = N_D + N_d$$

In step S36, it is determined whether the total printed dot number $N_D$ is larger than $1.5\times10^5$ or not. In the case that it is determined the total printed dot number $N_D$ is larger than $1.5\times10^5$, the subroutine goes to Step S37 in which wiping flag $F_W$ is set to 1, whereby this interruption processing is completed.

In the case that it is determined in Step S32 that timer count value $C_T$ is 100 or less, the subroutine goes to Step S34 and subsequent ones, and in the case that it is determined in Step S36 that total printed dot number $N_D$ is $1.5\times10^5$ or less, this interruption processing is terminated.

In this embodiment, it is preferable that driving frequency for preliminary ejection is set to a possibly low frequency in order to prevent ink adhering ingredient from being deposited on the heat generating element 1*e* by preliminary ejection. It is desirable that the preliminary ejecting conditions noted in Table 1 are set to optimum ones based on ink composition or ink jet head structure. However, the present invention should not be limited to the aforementioned preliminary ejecting conditions.

Next, description will be made below with respect to an embodiment wherein a sum of width of first preliminary ejecting prepulse and width of main pulse is relatively larger than a sum of width of second preliminary prepulse and width of main pulse so as to remove ink adhering ingredient on the heat generating element 1*e* and eliminate the density fluctuation (hereinafter referred to a second concrete embodiment).

Figure 9:
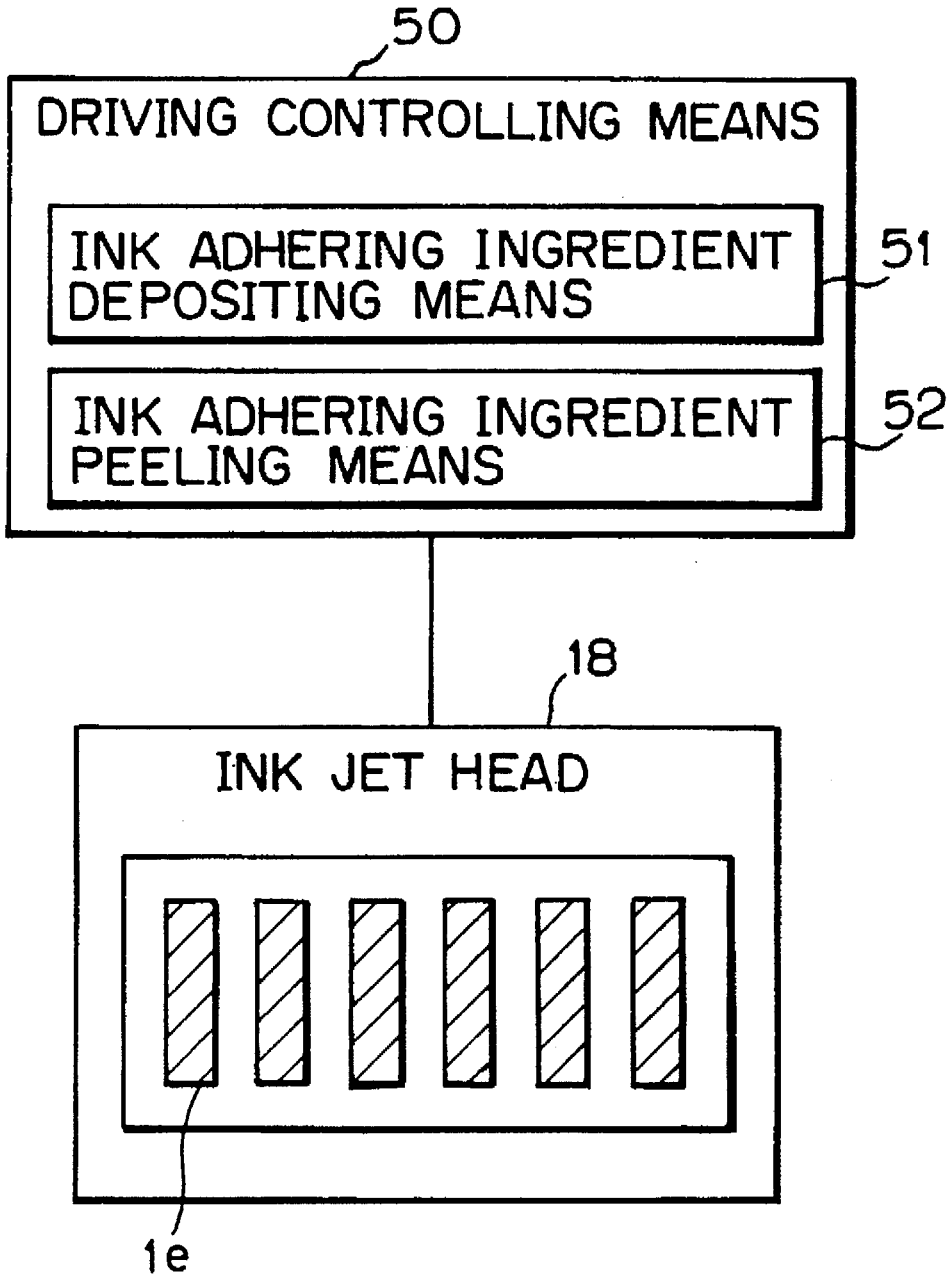
FIG. 9 is a control block diagram of a second concrete example in this embodiment.

As shown in FIG. 9 which represents the structure of this concrete example, driving controlling means 50 includes ink adhering depositing means 51 ad ink adhering ingredient peeling means 52 and drives and controls the heat generating element 1*e* in the ink jet head 1*e* in the following manner.

Specifically, in this complete example, first preliminary ejection for depositing ink adhering ingredient and second preliminary ejection for peeling the ink adhering ingredient are conducted. Since a sum of width of first preliminary ejection and width of main pulse is relatively larger than a sum of width of prepulse of second preliminary ejection and width of main pulse, ink adhering ingredient on the heat generating element 1*e* can be removed and density fluctuation can be eliminated.

Figures 10A, 10B, 10C, 10D, 10E:
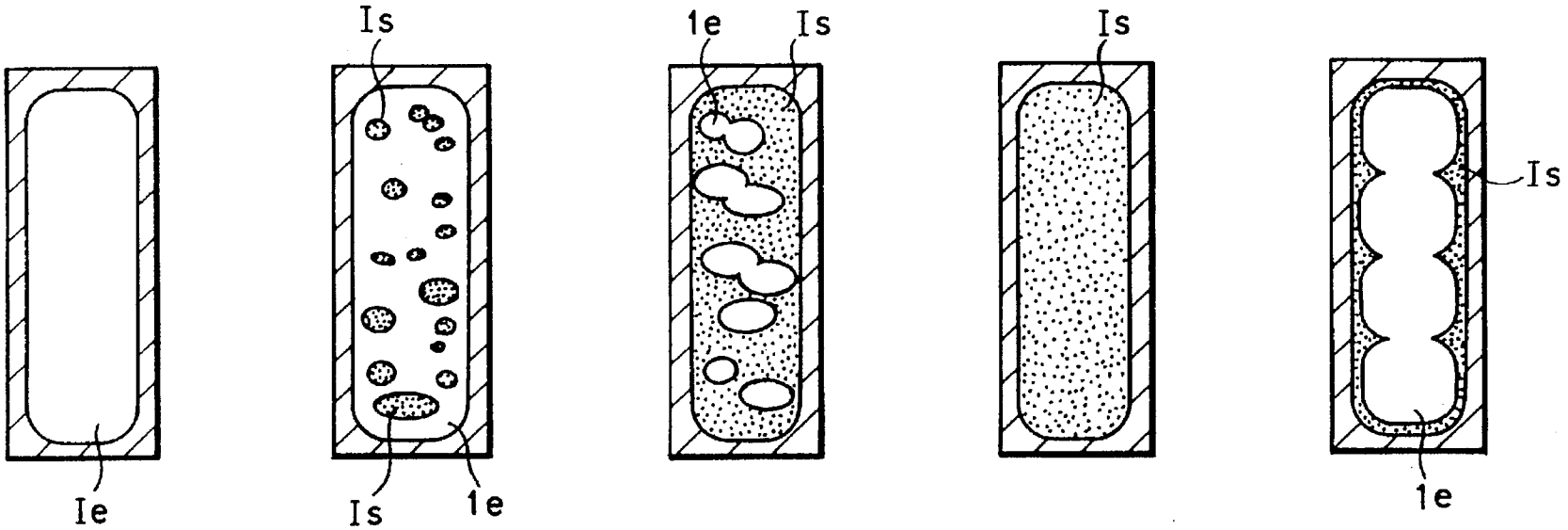
FIG. 10A–10E are schematic views which represents adhering deposition of ink adhering ingredient of an ink adhering ingredient on the surface of a heat generating element in an ink passage.

As described above with respect to the first concrete example, the ink adhering ingredient deposited on the heat generating element at the time of printing is repeatedly subjected to depositing and peeling. FIG. 10A–10E schematically show ink adhering ingredient on heat generating element at a certain time point of printing operation. FIG. 10A shows the initial state of the heat generating element 1*e*. As shown in FIG. 10B and FIG. 10C, ink adhering ingredient $I_s$ at a certain time point is irregularly adhesively deposited on the surface of the heat generating element 1*e*, and the state of adhesive deposition of ink adhering ingredient $I_s$ varies depending on the history of usage of the heat generating element 1*e*. A constant quantity of ink adhering ingredient $I_s$ uniformly deposited on the heat generating element 1*e* shown in FIG. 10D has a possibility that peeling of the ink adhering ingredient $I_s$ arises attributable to cavitation at the time of defoaming over the wide range on the surface of the heat generating element as shown in FIG. 10E. This has been clarified by a variety of reviews conducted by the inventors.

Namely, as shown in FIG. 10B and FIG. 10C, it is clarified that ink adhering ingredient $I_s$ uniformly distributed as shown in FIG. 10D is readily peeled from the surface of the heat generating element 1*e* rather than the ink adhering ingredient $I_s$ irregularly distributed on the heat generating element 1*e*. According to the present invention, the ink adhering ingredient $I_s$ is not substantially deposited on the surface of the heat generating element 1*e* by uniformly depositing ink adhering ingredient $I_s$ on the surface of the heat generating element 1*e* by the first preliminary ejection as shown in FIG. 10D and then by peeling the ink adhering ingredient $I_s$ deposited on the surface of the heat generating element Ie by the second preliminary ejection as shown in FIG. 10E, whereby the reduction of a quantity of ejection of ink due to the ink adhering ingredient $I_s$ is prevented, and moreover, the density fluctuation is prevented.

Driving conditions associated with the first preliminary ejection (preliminary ejection 1) and the second preliminary ejection (preliminary ejection 2*a*, preliminary ejection 2*b* and preliminary ejection 2*c*) as mentioned above are shown on Table 2.

TABLE 2

| | driving frequency (Hz) | width of prepulse (μs) | pause time (μs) | width of main pulse (μs) | number of pulse |
|---|---|---|---|---|---|
| preliminary ejection 1 | 6.25 × 1000 | 1.0 | 0.0 | 8.62 | 1000 |
| preliminary ejection 2a | 500 | 1.0 | 0.0 | 4.2 | 300 |
| preliminary ejection 2b | 500 | 1.0 | 0.9 | 4.2 | 300 |
| preliminary ejection 2c | 500 | 1.0 | 1.8 | 4.2 | 300 |

The preliminary ejection 1 is a preliminary ejection for assuring that ink adhering ingredient $I_s$ is uniformly deposited on the heat generating element 1*e*, and the preliminary ejection 2*a* to the preliminary ejection 2*c* are a preliminary ejection for assuring that the ink adhering ingredient $I_s$ deposited on the heat generating element 1*e* by the preliminary ejection 1 is removed, respectively.

Deposition of the ink adhering ingredient $I_s$ on the heat generating element 1*a* by the preliminary ejection 1 is readily achieved more and more as the driving frequency is higher, and moreover, a sum of width of prepulse and width of main pulse is larger. Therefore, a quantity of consumption of ink can be reduced by elongating the pulse width with high driving frequency. However, it is preferable in consideration of durability of the heat generating element 1*e* that the quantity of consumption of ink is determined within the range where any inconvenience does not arise in practical use.

As described above with respect to the first concrete example, the preliminary ejection 2*a* to the preliminary ejection 2*c* change a quantity of ejection by modulating the pause time, and it is possible to remove the ink adhering Ingredient $I_s$ on the heat generating element 1*e* within the whole range by shifting on the heat generating element 1*e* the position of cavitation caused by changing of the quantity of ejection. Here, the width of pause time has been modulated to enhance the effect, but since the ink adhering ingredient $I_s$ deposited by the preliminary ejection is readily peeled, good results are obtainable without any necessity for modulating the width of pause time.

Figure 11:
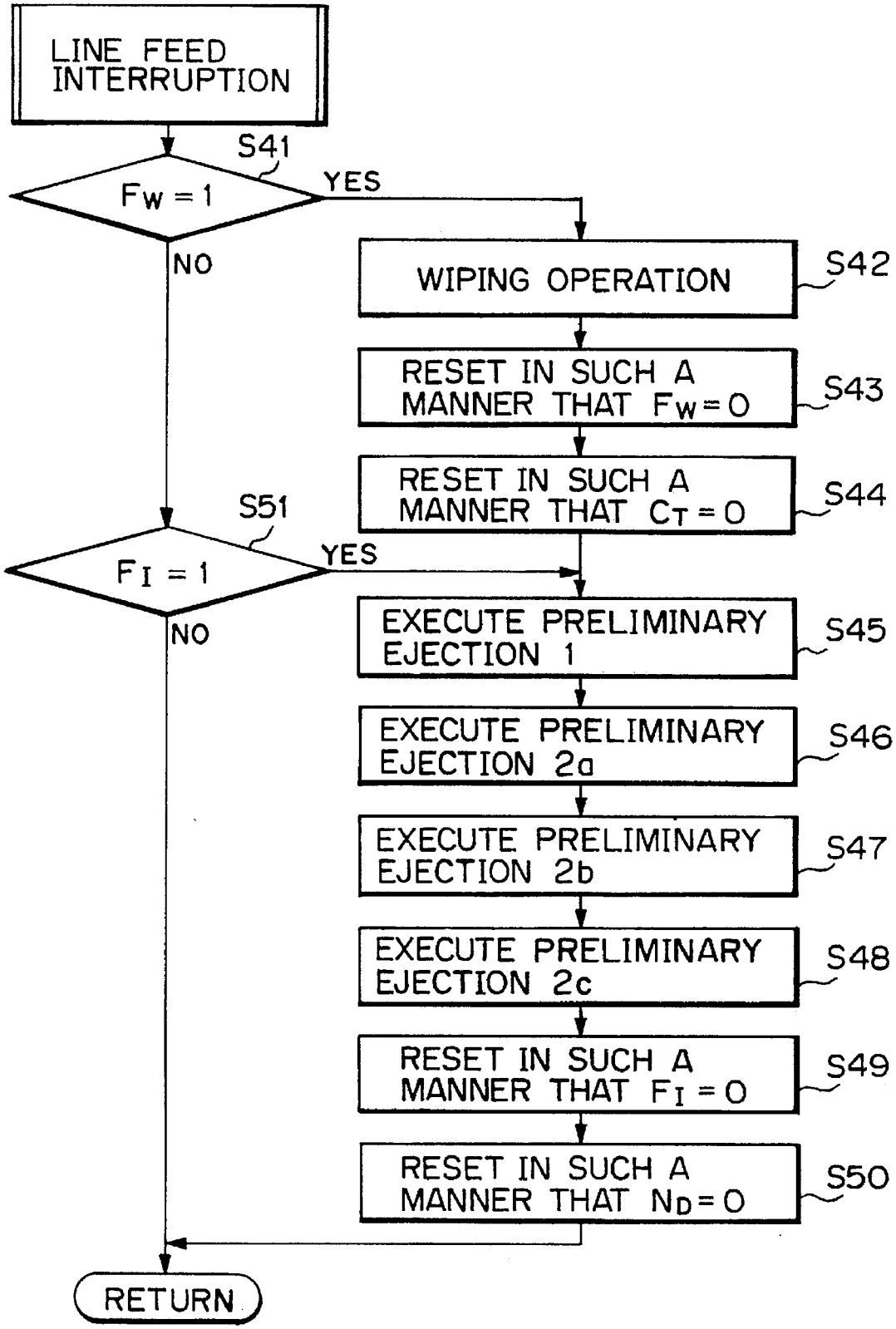
FIG. 11 is a flowchart which represents a series of steps for line feed interruption processings in the second concrete example in this embodiment.

FIG. 11 shows a series of steps of preliminary ejection processings in accordance with this embodiment. FIG. 11 illustrates a line feed interruption subroutine to be practiced every time line is changed. With this subroutine, it is determined whether or not preliminary ejection flag $F_1$and wiping flag $F_w$ are set to 1. In the case that it is found that the wiping flag is set to 1, wiping operation is performed, and subsequently, preliminary ejections 1 to 2*c* are performed. After completion of each processing, flag is reset to 0, and at the same time, timer count value $C_T$ is reset to 0. In detail, it is determined in Step S41 whether or not the wiping flag $F_W$ is set to 1, and in the case that it is determined that it is set to 1, the routine goes to Step S42 in which wiping operation is performed. Subsequently, in Step S43, the wiping flag $F_w$ is reset to 0, and in Step S44, the timer count value $C_r$ is reset to 0. After the subroutine successively goes to Step S45 to Step S48 to perform the preliminary ejection 1 to 2*c*, in Step S49, preliminary ejection flag $F_1$ is reset to 0, and subsequently, in Step S50, a total printed dot number $N_D$ is reset to 0, whereby interruption processings are terminated.

On the other hand, in the case it is determined in Step S41 that the wiping flag $F_w$ is not set to 1, the subroutine goes to Step S51 in which is determined whether or not the preliminary flag F1 is set to 1. In the case that it is determined that the preliminary ejection flag $F_1$ is set to 1, the subroutine goes to Step S45 and subsequent ones. In the case that it is determined that the preliminary ejection flag F1 is reset to 0, the interruption processing is terminated while nothing is done. With respect to a method of setting the preliminary ejection flag $F_1$ and wiping flag $F_w$, each setting is practiced in accordance with the 50 millisecond interruption subroutine as shown in FIG. 8.

In such manner, by adhesively depositing the ink adhering ingredient $I_s$ on the heat generating element 1*e* by the first preliminary ejection and peeling the ink adhering ingredient $I_s$ by the second preliminary ejection, it becomes possible to remove the ink adhering ingredient $I_s$ irregularly deposited on the heat generating element 1*e*. Thus, all the heat generating elements 1*e* each having different state of usage can has a same quantity of ejection, and moreover, eliminate density fluctuation. In addition, with ink which is readily deposited on the heat generating element 1*e* and of which ejection quantity is immediately reduced, according to the present invention, ink adhering ingredient $I_s$ on the heat generating element 1*e* can be removed, and a width of selection of ink can be widened much more than up to this time.

Figure 12:
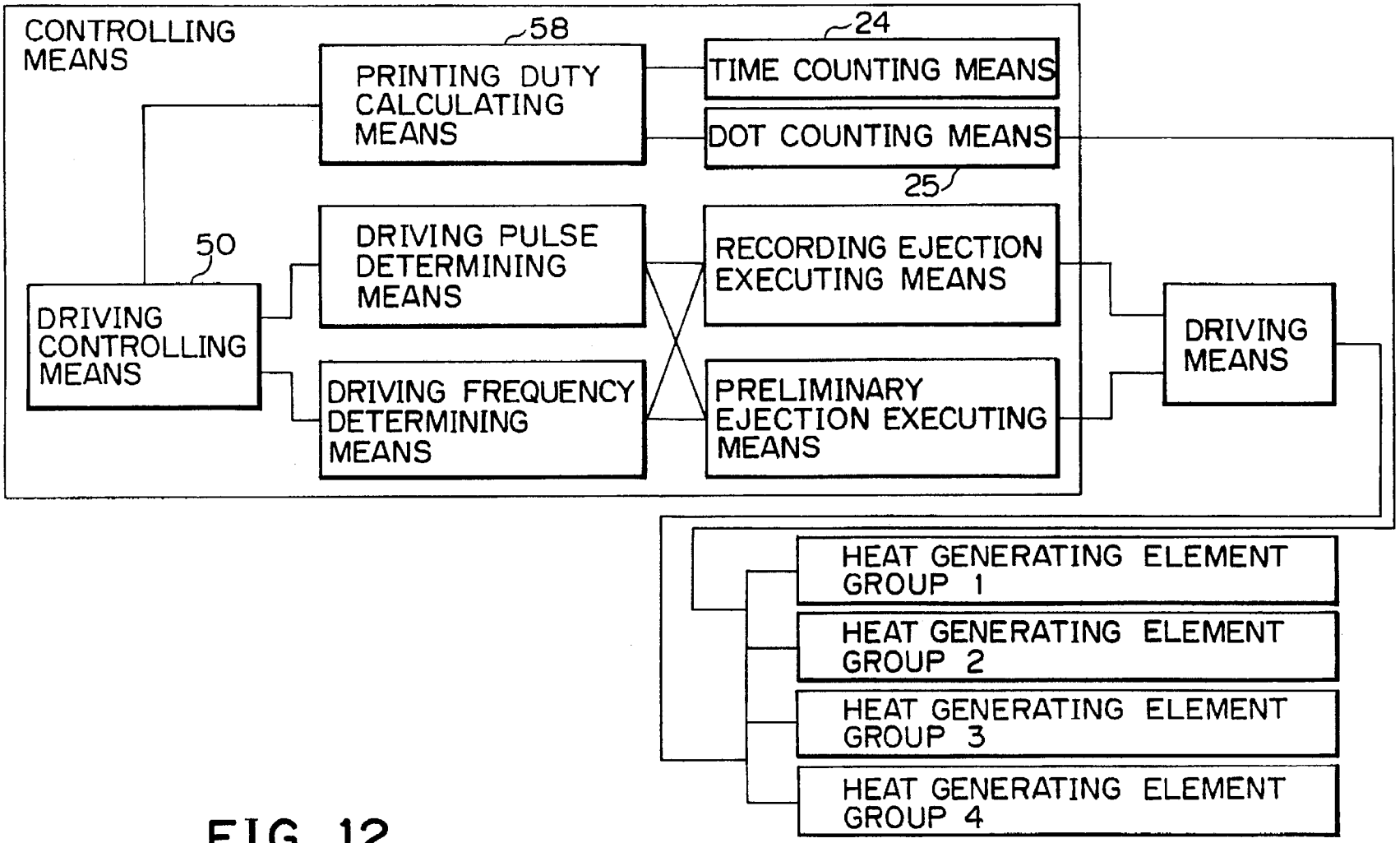
FIG. 12 is a control block diagram of a third embodiment in this embodiment.

Next, description will be made below as to an example wherein a quantity of ink adhering ingredient $I_s$ deposited on the surface of each of a plurality of heat generating elements 1*e* is presumed with respect of each of a group of heat generating elements so that density fluctuation is further reduced by performing preliminary ejection corresponding to the presumed quantity of deposited ink adhering ingredient (hereinafter referred to as a third concrete example) $I_s$. Here, to simplify description, it is assumed that adjacent four heat generating elements 1*e* are taken as one heat generating element group. FIG. 12 shows control blocks wherein four groups of heat generating elements, i.e., an ink jet head having sixteen ejecting ports 1*b* formed thereon is taken as an object to be controlled.

Specifically, controlling means includes printing duty calculating means 58, time counting means 24, and dot counting means 25. The time counting means 24 counts predetermined time. In this embodiment, the time counting means 24 counts 10 seconds and the dot counting means 25 counts the number of times of ejections executed by the heat generating elements 1*e*. In addition, the dot counting means 25 independently counts four groups of heat generating elements, and the printing duty calculating means 56 calculates a printing duty for each of the groups of heat generating elements from the number of times of ejections executed for 10 seconds so that preliminary ejection is performed corresponding to the calculated printing duty.

For example, in the case that full area printing is continuously performed for 10 seconds with 6.25 kHz, the number $N_{max}$ of printed dots is represented by the following equation.

$$N_{max}=(6.25\times10^3)\times10\times16$$

$$=1\times10^6 \text{ (shots)}$$

Thus, for example, in the case that a heat generating element group 1 performs ejection by $2\times10^5$ (shots) for 10 seconds, a heat generating element group 2 performs ejection by $1\times10^5$ (shots) for ten seconds, and a heat generating element group 3 performs ejection by $1\times10^4$ (shots) for ten seconds and a heat generating element group 4 performs ejection by $7\times10^5$ (shots) for ten seconds, the printing duty (duty 1 to duty 4) to be borne by each heat generating element group is expressed by the following equations.

$$\text{duty } 1\times\{(2\times10^5)/(1\times10^6)\}\times100$$

$$=20 \text{ (\%)}$$

$$\text{duty } 2=\{(3\times10^5)/(1\times10^6))\}\times100=30 \text{ (\%)}$$

$$\text{duty } 3=\{(1\times10^4)/(1\times10^5)\}\times100=1\%$$

$$\text{duty } 4=\{(7\times10^5)/(1\times10^6)\}\times100=70\%$$

Preliminary ejection was performed for each of the heat generating element groups in consideration of the foregoing results. One example representing preliminary ejection conditions corresponding to the respective printing duties is shown in Table 3 and Table 4.

TABLE 3

| printing duty (%) | the number of first preliminary ejection dots | the number of second preliminary ejection A dots | the number of first preliminary ejection B dots | the number of first preliminary ejection C dots |
|---|---|---|---|---|
| zero to less than 10 | 50 | 20 | 20 | 20 |
| 10 or more to less than 20 | 100 | 40 | 40 | 40 |
| 20 or more to less than 30 | 150 | 50 | 50 | 50 |
| 30 or more to less than 40 | 200 | 70 | 70 | 70 |
| 40 or more to less than 50 | 250 | 90 | 90 | 90 |
| 50 or more to less than 60 | 300 | 100 | 100 | 100 |
| 60 or more to less than 70 | 350 | 120 | 120 | 120 |
| 70 or more to less than 80 | 400 | 140 | 140 | 140 |
| 80 or more to less than 90 | 450 | 150 | 150 | 150 |
| 90 or more to less than 100 | 500 | 170 | 170 | 170 |

TABLE 4

| | driving frequency (Hz) | width of prepulse (μs) | pause time (μs) | width of main pulse (μs) |
|---|---|---|---|---|
| first preliminary ejection | 6.25 × 1000 | 1.0 | 0.0 | 8.62 |
| second preliminary ejection A | 500 | 1.0 | 0.0 | 4.2 |
| third preliminary ejection B | 500 | 1.0 | 0.9 | 4.2 |
| fourth preliminary ejection C | 500 | 1.0 | 1.8 | 4.2 |

Figure 13:
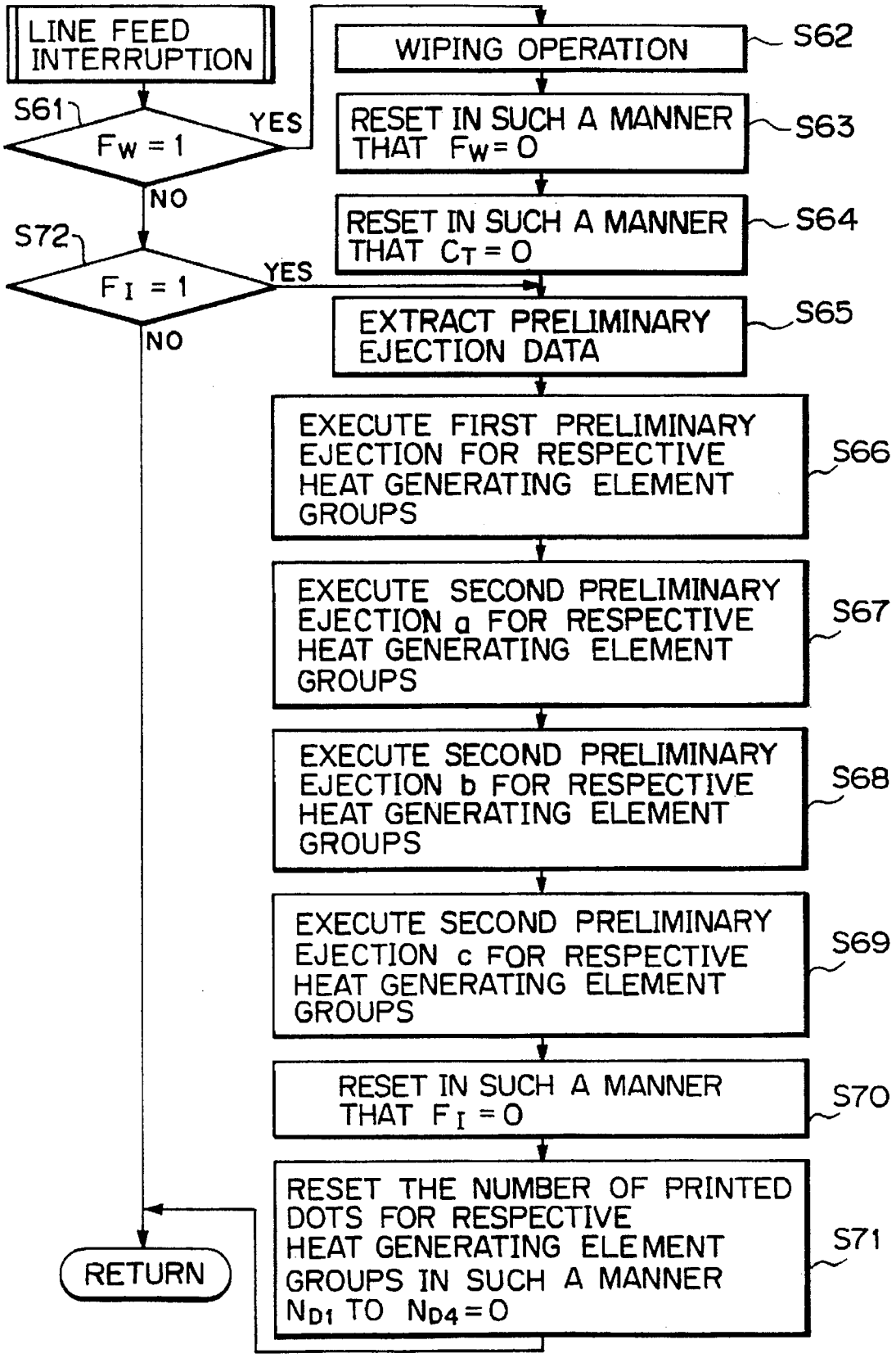
FIG. 13 is a flowchart which represents a series of steps of line feed interruption processings in the third concrete example.
Figure 14:
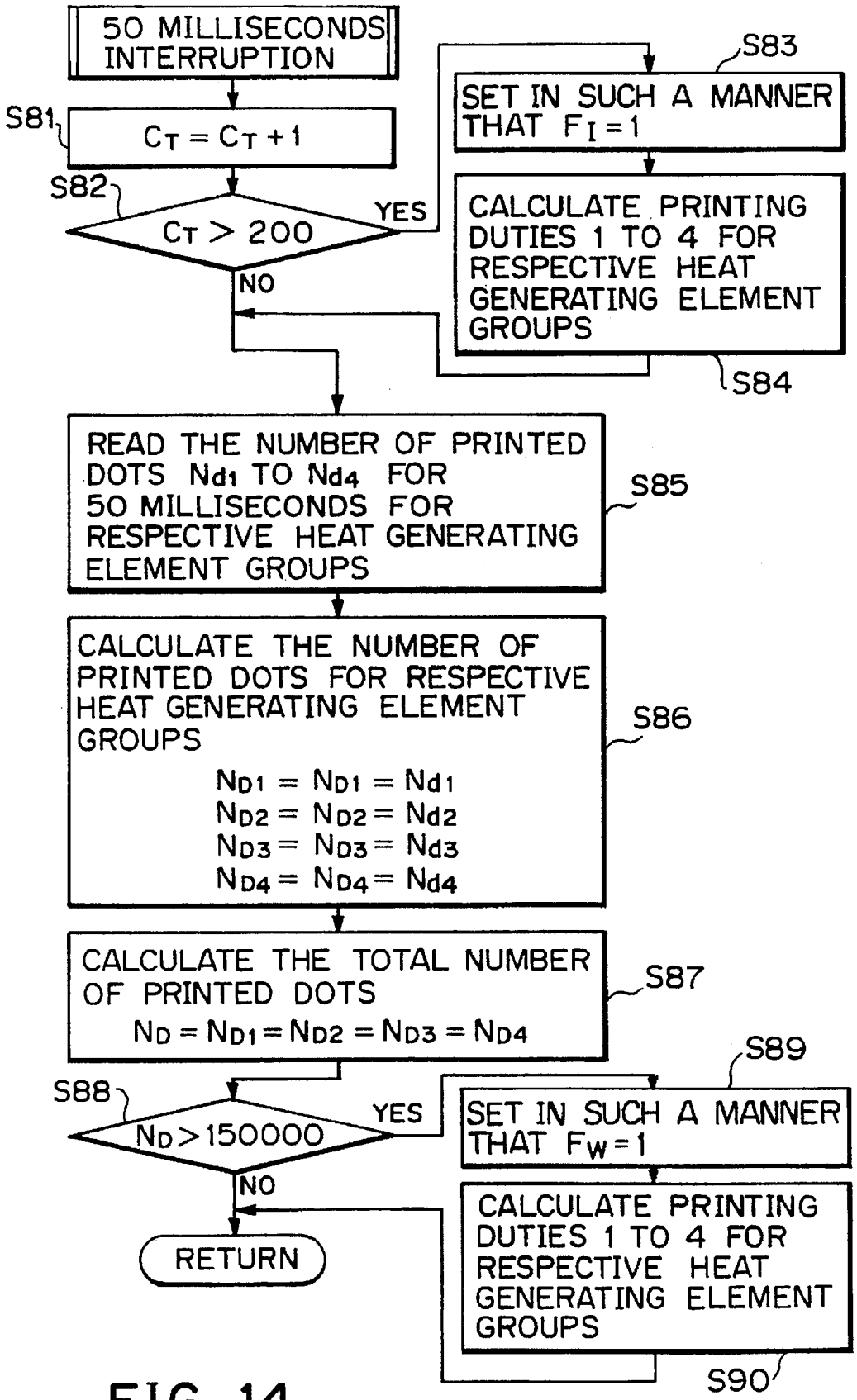
FIG. 14 is a flowchart which represents a series of steps of 50 millisecond interruption processing in the third concrete example.

FIG. 13 and FIG. 14 illustrates a series of steps of preliminary ejection processings to be practiced in accordance with this embodiment. FIG. 13 shows a line feed interruption subroutine to be executed every time each line is changed. FIG. 14 shows a 50 millisecond interruption subroutine to be executed every 50 milliseconds. In this embodiment, the first preliminary ejection and the second preliminary ejecting A to C as mentioned above are performed during printing operation as well as every 10 seconds at the standby when the capping member 13 is parted away from the ejection port plane 1*a* of the ink jet head 18, and moreover, they are performed also after the wiping operation in the case that the number of printed dots exceeds a predetermined one.

With the line feed interruption shown in FIG. 13, it is determined whether or not preliminary ejection flag $F_1$ and wiping flag $F_W$ are set to 1, and in the case that it is found that the wiping flag $F_w$ is set to 1, wiping operation is performed, and subsequently, first preliminary ejection and second preliminary ejection A to C are practiced. After completion of these processings, each flag is reset to 0, and moreover, count value $C_T$ of the timer is reset to 0. In detail, it is determined at Step S61 whether or not wiping flag $F_w$ is set to 1, and in the case that it is determined it is set to 1, the subroutine goes to Step S62 in which wiping operation is performed. Subsequently, in Step S 63, wiping flag $F_w$ is reset to 1, and moreover, in Step S64, timer count value $C_T$ is reset to 0. Then, in Step 65, necessary data are read from Table 3 and Table 4 and in Step S66 to Step 69, preliminary ejections A to D are successively performed, and thereafter, in Step S70, preliminary ejection flag $F_1$ is reset to 0, and additionally, in Step S71, total printed dot numbers $N_{D1}$ to $N_{D4}$ for the respective heat generating element groups are rest to 0, whereby interrupt processings are terminated.

On the other hand, in the case that it is determined in Step S61 that wiping flag $F_W$ is not set to 1, the subroutine goes to Step S72 in which it is determined whether or not preliminary ejection flag $F_1$ is st to 1. In the case that it is determined that preliminary ejection flag $F_1$ is set to 1, the subroutine goes to Step S65 and subsequent ones but in the case that it is determined that the preliminarily ejection flag $F_1$ is reset to 0, interruption processings are terminated while nothing is done.

On the other hand, with 50 millisecond interruption shown in FIG. 14, 10 second timer and printed dot number timer perform counting operation, and in the case that the results derived from the counting operations exceed prescribed values, preliminary ejection flag $F_1$ and wiping flag $F_w$ are set to 1. Namely, in Step S81, timer counted value $C_r$ is raised up by one, and the subroutine goes to Step S82 in which it is determined whether or not timer counted value $C_r$ exceeds 200. In the case that it is determined that the timer counted value $C_4$ exceeds 200, the subroutine goes to Step S83 in which preliminary ejection flag $F_1$ is set to 1, and in Step S84, printing duties 1 to 4 for respective heat generating element groups are calculated. Thereafter, in Step S85, respective heat generating element group printed dot numbers $N_{d1}$ to $N_{d4}$ are read for 50 milliseconds till this time and Step S86, respective heat generating element group printed dot numbers $N_{D1}$ to $N_{D4}$ till this time are calculated based on the following equations.

$$N_{D1}=N_{D1}+N_{d1}$$

$$N_{D2}=N_{D2}+N_{d2}$$

$$N_{D3}=N_{D3}+N_{d3}$$

$$N_{D4}=N_{D4}+N_{d4}$$

Additionally, in Step 87, total printed dot number $N_D$ is calcualted based on the following equations.

$$N_D=N_{D1}+N_{D2}+N_{D3}+N_{D4}$$

And, it is determined in Step 88 whether or not the total printed dot number $N_D$ is larger than $1.5\times10^5$. In the case that it is determined that the total printed dot number $N_D$ is larger than $1.5\times10^5$, the subroutine goes to Step S89 in which wining flag $F_w$ is set to 1, and after printing duties 1 to 4 for the respective heat generating element groups are calculated in Step S90, interruption processings are terminated.

In the case that it is determined in Step S82 that the timer count value $C_{T\ l\ is}$ 300 less, the subroutine goes to Step S85 and subsequent ones, and in the case that it is determined in Step S88 that the total printed dot number $N_D$ is $1.5\times10^5$ or less, this interruption processing is terminated.

The reason why sixteen heat generating elements 1*e* are divided into four heat generating element groups like in this embodiment consists in that since density fluctuation on an image with the heat generating element 1*e* as a unit is hardly recognized, four heat generating elements 1*e* are processed as an unit so as to reduce a load to be borne by a main body of the ink jet apparatus. Therefore, in the case that calculation processing means of the ink jet apparatus has some allowance, it is acceptable that a quantity of deposition of the ink adhering ingredient $I_s$ is presumed with respect to each heat generating element 1*e* among a plurality of heat generating elements 1*e*. In this embodiment, printed dots are counted for ten seconds to presume a quantity of deposition of the ink adhering ingredient $I_s$, and preliminary ejection is executed under the conditions as described in Table 3 and Table 4, but it is preferable that a quantity of deposition of the ink adhering ingredient $I_s$ is set to an optimum value in association with the composition of ink or the structure of ink jet apparatus.

In such a manner, when a quantity of deposition on the ink adhering ingredient $I_s$ is on the heat generating element 1*e* is presumed every heat generating element 1*e* group, and preliminary ejection is performed corresponding to the quantity of deposition on the ink adhering ingredient $I_s$, adhering substance can be removed by cavitation induced at the time defoaming, and it is possible to perform a printing operation with a minimum quantity of ink ejection without any density fluctuation. In addition, with respect to ink of which ejection quantity is quickly reduced due to easy deposition on the surface of the heat generating element 1*e*, according to the present invention, it is possible to remove the ink adhering ingredient $I_s$ on the heat generating element 1*e*. This means that the width of selecting of ink can be widened much more than till this time.

With respect to a typical structure and operational principle of an ink jet system, it is preferable to employ a fundamental principle as disclosed in official gazettes of U.S. Pat Nos. 4,723,129 and 4,740,796. This type of principle is applicable to either one of an on-demand type ink jet system or a continuous type ink jet system. Especially, in the case of the on-demand type ink jet system, a heat generating element disposed corresponding to a sheet having ink held thereon or an ink passage is caused to generate thermal energy by applying thereto at least one driving signal for inducing rapid temperature rise in excess of appearance of a phenomenon of a nucleate boiling. Moreover, a phenomenon of film boiling appears on the heat functioning plane of an ink jet head. Consequently, bubbles can be formed in ink while corresponding to the driving signal in the one-to-one relationship. As bubbles grow or contract, ink is ejected through the ejection opening to form at least one droplet. When this driving signal is prepared in the form of a pulse, bubbles are immediately adequately grown and contracted. Thus, ink ejection can be achieved with excellent responsiveness. With respect to the pulse-shaped driving signal, it is recommendable that reference is made to official gazettes of U.S. Pat. Nos. 4,463,359 and 4,345,262. When the conditions described in an official gazette of U.S. Pat. No.

4,313,124 associated with the rate of temperature raise of the thermal working surface are employed, printing operation can be achieved with more excellent results.

With respect to the structure of an ink jet head, in addition to a combination structure made among ejection port, ink passage and heat generating element (straight liquid passage or passage at a right angle relative to the foregoing one), the structure disclosed in official gazettes of U.S. Pat. Nos. 4,558,333 and 4,459,600 associated with the thermal functioning portion and bent region are incorporated in the present invention. Further, the structure based on an official gazette of Japanese Patent Application Laid-Open NO. 123670/1984 disclosing the structure for allowing a common slit to serve as an ejecting potion of a heat generating element relative to a plurality of heat generating elements and the structure based on an official gazette of Japanese Patent Application Laid-Open NO. 138461/1984 disclosing the structure including an opening hole for absorbing the pressure wave of thermal energy corresponding an ejection portion are effectively employable for the present invention. Namely, regardless of the contour of the ink jet head, according to the present invention, printing can reliably be achieved at a high efficiency.

In addition, the present invention can advantageously be applied to a full line type ink jet head having a length corresponding to a maximum width which can be printed by the ink jet apparatus. As such an ink jet head as mentioned above, either of the structure satisfying a length by combination of a plurality of ink jet head and the structure as a single integrally formed ink jet head is acceptable.

Further, among the serial type ink jet heads, an ink jet head fixed to the main body of the apparatus or an exchangeable tip type ink jet head which makes it possible to be electrically connected by fitting to the main body of the apparatus and to which ink can be supplied or a cartridge type ink jet head including an ink tank integrated with the ink jet head itself are effectively employable for the present invention.

As the structure of the ink jet apparatus of the present invention, since additional arrangement of ejection recovering means of the ink jet head, and preparative assisting means can stabilize effects of the present invention, they are preferably employable for the present invention. Concretely, they are exemplified by capping means fitted to ink jet head, cleaning means, pressurizing means or sucking means, heat generating element and heating element separately arranged from the heat generating element, preparative heating means for performing heating by using a combination of the aforementioned elements, and preparative ejecting means adapted to perform ejecting separately from printing.

With respect to the kind of the number of ink jet heads to be mounted on the ink jet apparatus, a single ink jet head is arranged for, e.g., a monochromatic color. Alternatively, plural ink jet heads may be arranged corresponding to plural kind of inks each different printing color and density. For example, as a printing mode of the ink jet apparatus, not only a printing mode having a main color such as black color employed but also plural printing modes based on different colors or full color derived from mixing of colors are effectively employable for the present invention. In this case, the ink jet head may integrally be constructed or plural sets of ink jet heads may be combined with each other.

In the embodiment as mentioned above, each ink to be used has been explained as a liquid. Alternatively, ink which is kept solid at a temperature equal to or lower than a room temperature but softened or liquidized at the room temperature may be used. In the ink jet system, since the temperature of ink to be used is generally controllably adjusted within the temperature range of 30 ° C. or more to 70° C. or less so as to allow the viscosity of the ink to be maintained within the stable range, ink which is liquidized when a recording signal is applied to the printing head may be used. To positively prevent the temperature of ink from being elevated due to the thermal energy applied to the recording head by utilizing the energy arising when the solid state of ink is transformed into the liquid state or to prevent the ink from being vaporized, ink which is kept solid in the unused state by liquidized on receipt of heat may be used. At any rate, the present invention can be applied to the case that in response to a recording signal, ink is liquidized on receipt of thermal energy and the liquid ink is then ejected from the recording head, the case that ink starts to be solidified when an ink droplet reaches a printing medium, and the case that ink having such a nature that it is liquidized only in response to application of thermal energy to the printing head is used.

According to the present invention, a most effective ink jet system applicable to the inks as mentioned above is a film boiling system.

In addition, the ink jet apparatus of the present invention can be employed not only as image output terminal of an information processing unit such as a computer or the like but also as an output unit of a copying machine combined with an optical reader as an output unit of a facsimile having a signal sending/receiving function.

According to the present invention, since ink adhering ingredient deposited on a heat generating element while coming in contact with ink owing to defoaming position changing means can be removed within a wide range, density fluctuation in character, image or the like can be removed compared with the conventional ink jet apparatus.

Since ink adhering ingredient deposited on the printing element can effectively removed by preliminary ejection conduced with the aid of ink adhering ingredient depositing means and ink adhering ingredient peeling means, the kind of ink ingredient utilizable by the ink jet system can be augmented.

Moreover, a quantity of consumption of ink necessary for preliminary ejection can be minimized by carrying out preliminary ejection corresponding to the state of usage of the heat generating element.

The present invention has been described in detail with respect to preferred embodiments, and it will be now be that changes and modifications may be made without departing from the invention in its broader aspects, and it is the intention, therefore, in the appended claims to cover all such changes and modifications as fall within the true spirit of the invention.

What is claimed is:

1. An ink jet apparatus including an ink jet head having a plurality of ejecting ports arranged in a predetermined pattern and a plurality of heat generating elements arranged corresponding to said ejecting ports, and driving controlling means applying a driving signal to said heat generating elements in response to a driving information so as to allow said heat generating elements to generate heat to generate bubbles from ink and to defoam wherein a print ejecting mode for printing a printing medium by ejecting ink from said ejecting ports and a preliminary ejecting mode for performing no ejection toward said printing medium are settled for said apparatus, characterized in that said driving controlling means includes defoaming position changing means for changing the position of a defoaming point while said apparatus is operated in conformity with said preliminary ejecting mode.

2. An ink jet apparatus as claimed in claim 1, characterized in that said driving signal is composed of a prepulse, a main pulse, and a pause time between said prepulse and said main pulse, and that said defoaming position changing means performs ejection by modulating at least one of said prepulse and said pause time by two steps or more so as to change the position of said defoaming point.

3. An ink jet apparatus including an ink jet head having a plurality of ejecting ports arranged in a predetermined pattern and a plurality of heat generating elements arranged corresponding to said ejecting ports, and driving controlling means applying a driving signal to said heat generating elements in response to a driving information so as to allow said heat generating elements to generate heat to generate bubbles from ink and to deform wherein a print ejecting mode for printing a printing medium by ejecting ink from said ejecting ports and a preliminary ejecting mode for performing no ejection toward said printing medium are settled for said apparatus, characterized in that said driving and controlling means includes ink adhering ingredient depositing means for allowing a predetermined quantity of ink adhering ingredient to be preliminarily adhesively deposited on said heat generating elements in conformity with said preliminary ejecting mode, and ink adhering ingredient peeling means for peeling said ink adhering ingredient on said heat generating elements deposited by said ink adhering ingredient depositing means.

4. An ink jet apparatus as claimed in claim 3, characterized in that said ink adhering ingredient depositing means changes and drives at least one of a width of driving signal, a driving voltage and a driving cycle in such a manner that a maximum reached point temperature of the surface of each heat generating element coming in contact with ink is relatively heightened, and that said ink adhering ingredient peeling means changes and drives at least one of a width of driving signal, a driving voltage and a driving cycle in such a manner that a maximum reached temperature of the surface of each heat generating element coming in contact with ink is relatively lowered.

5. An ink jet apparatus as claimed in claim 4, characterized in that a sum $P_{W1}$ of a width of prepulse and a width of main pulse of said driving signal applied to said heat generating elements by said ink adhering ingredient depositing means and a sum $P_{W2}$ of a width of prepulse and a width of main pulse of said driving signal applied to said heat generating elements by said ink adhering ingredient peeling means satisfy the relationship represented by the following inequality.

$$1.1\times P_{W1} \leqq P_{W2} \leqq 2.5\times P_{W1}$$

6. An ink jet apparatus as claimed in claim 4 or claim 5, characterized in that a cycle $F_{q1}$ that said ink adhering depositing means applies a driving signal to a same heat generating element and a cycle $F_{q2}$ that said ink adhering ingredient peeling means applies a driving signal to a same heat generating element satisfy the relationship represented by the following inequality.

$$F_{q1}<F_{q2}$$

7. An ink jet apparatus including an ink jet head having a plurality of ejecting ports arranged in a predetermined pattern and a plurality of heat generating elements arranged corresponding to said ejecting ports, and driving controlling means applying a driving signal to said heat generating elements in response to a driving information so as to allow said heat generating elements to generate heat to generate bubbles from ink and to defoam wherein a print ejecting mode for printing a printing medium by ejecting ink from said ejecting ports and a preliminary ejecting mode for performing no ejection toward said printing medium are settled for said apparatus, characterized in that said driving controlling means includes ink adhering depositing means for allowing a predetermined quantity of ink adhering ingredient to be preliminarily deposited on said heat generating elements in conformity with said preliminary ejecting mode, ink adhering ingredient peeling means for peeling said ink adhering ingredient on each heat generating element deposited by said ink adhering ingredient depositing means, and heat generating element usage state capturing means for capturing the usage state of each heat generating element or dividing said heat generating elements into at least two groups to capture the usage state of each of divided heat generating elements, and that said driving signal is controlled in conformity with said preliminary ejecting mode based on the usage state captured by said heat generating element usage state capturing means.

8. An ink jet apparatus as claimed in claim 7, characterized in that said heat generating element usage state capturing means includes printing dot counting means, counting means for counting a printing time, and means for seeking a printing duty, and that the usage state of each heat generating element is captured by said means for seeking a printing duty.

9. An ink preliminary ejecting method to be practiced by an ink jet apparatus including an ink jet head having a plurality of ejecting ports arranged in a predetermined pattern and a plurality of heat generating elements arranged corresponding to said ejecting ports, and driving controlling means applying a driving signal to said heat generating elements in response to a driving information so as to allow said heat generating elements to generate heat to generate bubbles from ink and to defoam wherein a print ejecting mode for printing a printing medium by ejecting ink from said ejecting ports and a preliminary ejecting mode for performing no ejection toward said printing medium are settled for said apparatus, characterized in that said preliminary ejecting mode includes a first preliminary ejecting step of allowing a predetermined quantity of ink adhering ingredient to be deposited on each heat generating element and a second preliminary adhering step of peeling from said heat generating elements an ink adhering ingredient adhesively deposited by practicing said first preliminary ejecting step.

* * * * *

UNITED STATES PATENT AND TRADEMARK OFFICE

CERTIFICATE OF CORRECTION

PATENT NO. : 5,638,100

DATED : June 10, 1997

INVENTOR(S) : DAIGORO KANEMATSU ET AL.

It is certified that error appears in the above-identified patent and that said Letters Patent is hereby corrected as shown below:

In the Drawings:

DRAWING SHEET 8

Figure 8, "$N_T$ > 150000" should read --$N_D$ > 150000--.

COLUMN 1

Line 13, "kind" should read --kinds--.
Line 20, "a laser" should read --and a laser--.
Line 25, "finesse" should read --fineness--.
Line 26, "few nosy sound is" should read --few noisy sounds are--.

COLUMN 2

Line 20, "staying" should read --remaining--.
Line 53, "large" should read --greatly--.
Line 61, "ad" should read --and--.
Line 66, "other" should read --another--.
Line 67, "practices" should read --practiced--.

COLUMN 3

Line 11, "arrange" should read --arranged--.
Line 30, "deforming" should read --defoaming--.
Line 67, Close up right margin.

COLUMN 4

Line 11, "element" should read --elements--.
Line 34, "capturing" should read --state capturing--.

UNITED STATES PATENT AND TRADEMARK OFFICE

CERTIFICATE OF CORRECTION

PATENT NO. : 5,638,100

DATED : June 10, 1997

INVENTOR(S) : DAIGORO KANEMATSU ET AL.

It is certified that error appears in the above-identified patent and that said Letters Patent is hereby corrected as shown below:

COLUMN 5

Line 1, "second" should read --the second--.
Line 43, "processings" should read --processing--.

COLUMN 6

Line 7, "a" should read --the --.
Line 25, "head 8" should read --head 18--.
Line 61, "limited" should read --limited to--.

COLUMN 7

Line 52, "bit" should read --bits--.

COLUMN 8

Line 13, "bolding" should read --bonding--.
Line 14, "element Ie." should read --element 1e.--.
Line 43, "deforming" should read --defoaming--.
Line 47, "redetermined" should read --predetermined--.

COLUMN 10

Line 3, "Step 21" should read --Step S21--.
Line 14, "Step 31," should read -- Step S31,--.
Line 15, "Step 32" should read --Step S32--.
Line 21, "flag F1" should read --flag $F_1$--.

UNITED STATES PATENT AND TRADEMARK OFFICE

CERTIFICATE OF CORRECTION

PATENT NO. : 5,638,100

DATED : June 10, 1997

INVENTOR(S) : DAIGORO KANEMATSU ET AL.

It is certified that error appears in the above-identified patent and that said Letters Patent is hereby corrected as shown below:

COLUMN 10, CONTINUED

Line 54, "a" should read --as--.
Line 58, "ad" should read --and--.
Line 60, "head 1e" should read --head 18--.
Line 61, "complete" should read --concrete--.

COLUMN 11

Line 66, "element 1a" should read --element 1e--.

COLUMN 12

Line 47, "flag F1" should read --flag $F_1$--.
Line 60, "has" should read --have--.

COLUMN 13

Line 51, "duty 1X" should read --duty 1=--.

COLUMN 14

Line 65, "ejecting A" should read --ejection A--.

COLUMN 15

Line 18, "Step 65," should read --Step S65,--.
Line 19, "Step 69," should read --Step S69,--.
Line 24, "rest" should read --reset-- and "interrupt" should read --interruption--.

UNITED STATES PATENT AND TRADEMARK OFFICE

CERTIFICATE OF CORRECTION

PATENT NO. : 5,638,100

DATED : June 10, 1997

INVENTOR(S) : DAIGORO KANEMATSU ET AL.

It is certified that error appears in the above-identified patent and that said Letters Patent is hereby corrected as shown below:

COLUMN 15, CONTINUED

Line 28, "st" should read --set--.
Line 31, "preliminarily" should read --preliminary--.
Line 43, "value $C_4$" should read --value $C_r$--.
Line 48, "and" should read --and in--
Line 59, "Step 87," should read --Step S87,--.
Line 60, "calcualted" should read --calculated-- and "equations." should read --equation.--.
Line 64, "Step 88" should read --Step S88--.

COLUMN 16

Line 1, "wining" should read --wiping--.
Line 6, "$C_{T1}$ is 300 less," should read --$C_T$ is 300 or less,--.
Line 15, "an" should read --a--.
Line 35, "time" should read --time of--.

COLUMN 17

Line 19, "corresponding" should read --corresponding to--.
Line 29, "head" should read --heads--.

UNITED STATES PATENT AND TRADEMARK OFFICE

CERTIFICATE OF CORRECTION

PATENT NO. : 5,638,100

DATED : June 10, 1997

INVENTOR(S) : DAIGORO KANEMATSU ET AL. Page 5 of 5

It is certified that error appears in the above-identified patent and that said Letters Patent is hereby corrected as shown below:

COLUMN 18

Line 10, "by" should read --but--.
Line 35, "removed" should read --be removed--.
Line 36, "conduced" should read conducted--.
Line 45, "now be" should read --known--.

Signed and Sealed this

Thirty-first Day of March, 1998

*Attest:*

*Attesting Officer*

BRUCE LEHMAN

*Commissioner of Patents and Trademarks*